US011845268B2

(12) United States Patent
Murase et al.

(10) Patent No.: US 11,845,268 B2
(45) **Date of Patent: *Dec. 19, 2023**

(54) PRINTING APPARATUS AND METHOD OF JUDGING NOZZLE DISCHARGE STATE OF PRINTING APPARATUS

(71) Applicant: CANON KABUSHIKI KAISHA, Tokyo (JP)

(72) Inventors: Takeshi Murase, Yokohama (JP); Yoshiaki Murayama, Tokyo (JP); Satoshi Kitai, Kawasaki (JP); Masahiko Umezawa, Kawasaki (JP); Tomoki Kobayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

This patent is subject to a terminal disclaimer.

(21) Appl. No.: 17/235,124

(22) Filed: Apr. 20, 2021

(65) Prior Publication Data

US 2021/0252851 A1 Aug. 19, 2021

Related U.S. Application Data

(63) Continuation of application No. 16/533,859, filed on Aug. 7, 2019, now Pat. No. 11,020,959.

(30) Foreign Application Priority Data

Aug. 7, 2018 (JP) ..... 2018-148715
Feb. 28, 2019 (JP) ..... 2019-036837

(51) Int. Cl.
*B41J 2/045* (2006.01)
*B41J 2/21* (2006.01)
*B41J 2/14* (2006.01)

(52) U.S. Cl.
CPC ..... *B41J 2/0451* (2013.01); *B41J 2/0458* (2013.01); *B41J 2/04561* (2013.01);
(Continued)

(58) Field of Classification Search
CPC .. B41J 2/0451; B41J 2/04561; B41J 2/04563; B41J 2/04565; B41J 2/0458;
(Continued)

(56) References Cited

U.S. PATENT DOCUMENTS 6,089,695 A 7/2000 Takagi et al.
6,652,056 B2 11/2003 Shioya
(Continued)

FOREIGN PATENT DOCUMENTS

CN 101092082 A 12/2007
CN 101665021 A 3/2010
(Continued)

OTHER PUBLICATIONS

Extended European Search Report dated Jan. 30, 2020, in European Patent Application No. 19190478.8.
(Continued)

*Primary Examiner* — Henok D Legesse
(74) *Attorney, Agent, or Firm* — Venable LLP

(57) ABSTRACT

A printing apparatus for printing using a printhead including a plurality of nozzles, each configured to discharge ink, and a plurality of sensors, corresponding to the plurality of nozzles, for detecting a discharge state of ink from the plurality of nozzles, judges a discharge state. The apparatus prints, based on print data, an image by driving the printhead under a first drive condition to discharge the ink from the printhead to a first area, discharges ink to a second area different from the first area by driving the printhead, based on inspection data, under a second drive condition different from the first drive condition, and judges a discharge state of each nozzle by monitoring an output from each sensor at a timing of driving the printhead under the second drive condition.

35 Claims, 23 Drawing Sheets

(52) U.S. Cl.
CPC ..... *B41J 2/04563* (2013.01); *B41J 2/04565* (2013.01); *B41J 2/04588* (2013.01); *B41J 2/2142* (2013.01); *B41J 2/04543* (2013.01); *B41J 2/04551* (2013.01); *B41J 2/04553* (2013.01); *B41J 2/04591* (2013.01); *B41J 2/14153* (2013.01); *B41J 2002/14354* (2013.01)

(58) Field of Classification Search
CPC .. B41J 2/04588; B41J 2/2142; B41J 2/04543; B41J 2/04551; B41J 2/04553; B41J 2/04591; B41J 2/14153; B41J 2002/14354; B41J 2/04528; B41J 2/04541; B41J 2/04573; B41J 2/14072; B41J 2202/12; B41J 2202/18; B41J 2202/20; B41J 2202/21; B41J 2/01; B41J 29/38; B41J 2/125; B41J 2/04536
See application file for complete search history.

(56) References Cited

U.S. PATENT DOCUMENTS

| | | | |
|---|---|---|---|
| 7,806,503 | B2 | 10/2010 | Aoki et al. |
| 7,997,717 | B2 | 8/2011 | Taniuchi et al. |
| 8,186,798 | B2 | 5/2012 | Aoki et al. |
| 8,845,060 | B2 | 9/2014 | Azuma et al. |
| 9,340,009 | B2 | 5/2016 | Murayama et al. |
| 9,434,196 | B2 | 9/2016 | Fukasawa et al. |
| 9,849,669 | B2 | 12/2017 | Fukazawa et al. |
| 10,755,151 | B2 | 8/2020 | Ishii et al. |
| 10,960,695 | B2 | 3/2021 | Murayama et al. |
| 11,020,959 | B2 * | 6/2021 | Murase ..... B41J 2/04541 |
| 2007/0291067 | A1 | 12/2007 | Aoki et al. |
| 2007/0291068 | A1 | 12/2007 | Aoki et al. |
| 2010/0053249 | A1 | 3/2010 | Matsushita et al. |
| 2011/0141188 | A1 | 6/2011 | Morita |
| 2012/0033006 | A1 | 2/2012 | Murayama et al. |
| 2012/0194587 | A1 | 8/2012 | Teshigawara et al. |
| 2015/0091960 | A1 | 4/2015 | Nakazawa et al. |
| 2015/0097885 | A1 | 4/2015 | Hosokawa |
| 2017/0232770 | A1 | 8/2017 | Akiyama et al. |
| 2019/0009546 | A1 | 1/2019 | Sakamoto et al. |
| 2019/0009594 | A1 | 1/2019 | Sakamoto et al. |
| 2020/0047492 | A1 | 2/2020 | Umezawa et al. |

FOREIGN PATENT DOCUMENTS

| | | | |
|---|---|---|---|
| CN | 110816054 | A | 2/2020 |
| JP | 2008-000914 | A | 1/2008 |
| JP | 2010-120301 | A | 6/2010 |
| JP | 2016-097636 | A | 5/2016 |
| KR | 10-2001-0062332 | A | 7/2001 |
| KR | 10-2006-0029234 | A | 4/2006 |

OTHER PUBLICATIONS

Office Action dated Feb. 3, 2021, in Chinese Patent Application No. 201910724882.9.
Office Action dated Sep. 29, 2022, in Korean Patent Application No. 10-2019-0095909 (7 pages).
Office Action dated Jun. 5, 2023, in Japanese Patent Application No. 2019-143922.

* cited by examiner

FIG. 14

NOZZLE (Nzl)

| COL. | BLK No. | FUNCTION | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|---|---|
| 1 | 0 | DISCHARGE | ● | | | | | | | | | | | | | | | |
| 1 | 1 | INSPECTION | | | | | | | | | | | | | | | | |
| 1 | 2 | DISCHARGE | | | ● | | | | | | | | | | | | | |
| 1 | 3 | INSPECTION | | | | | | | | | | | | | | | | |
| 1 | 4 | DISCHARGE | | | | | ● | | | | | | | | | | | |
| 1 | 5 | INSPECTION | | | | | | | | | | | | | | | | |
| 1 | 6 | DISCHARGE | | | | | | | ● | | | | | | | | | |
| 1 | 7 | INSPECTION | | | | | | | | | | | | | | | | |
| 2 | 0 | DISCHARGE | | ● | | | | | | | | | | | | | | |
| 2 | 1 | INSPECTION | | | | | | | | | | | | | | | | |
| 2 | 2 | DISCHARGE | | | | ● | | | | | | | | | | | | |
| 2 | 3 | INSPECTION | | | | | | | | | | | | | | | | |
| 2 | 4 | DISCHARGE | | | | | | ● | | | | | | | | | | |
| 2 | 5 | INSPECTION | | | | | | | | | | | | | | | | |
| 2 | 6 | DISCHARGE | | | | | | | | ● | | | | | | | | |
| 2 | 7 | INSPECTION | | | | | | | | | | | | | | | | |
| 3 | 0 | DISCHARGE | | | | | | | | | ● | | | | | | | |
| 3 | 1 | INSPECTION | | | | | | | | | | | | | | | | |
| 3 | 2 | DISCHARGE | | | | | | | | | | | ● | | | | | |
| 3 | 3 | INSPECTION | | | | | | | | | | | | | | | | |
| 3 | 4 | DISCHARGE | | | | | | | | | | | | | ● | | | |
| 3 | 5 | INSPECTION | | | | | | | | | | | | | | | | |
| 3 | 6 | DISCHARGE | | | | | | | | | | | | | | | ● | |
| 3 | 7 | INSPECTION | | | | | | | | | | | | | | | | |

FIG. 23A

| | |
|---|---|
| Level0 | PULSE SETTING FOR DISCHARGE DETECTION |
| Level1 | PULSE SETTING 1 FOR PRELIMINARY DISCHARGE |
| Level2 | PULSE SETTING 2 FOR PRELIMINARY DISCHARGE |
| Level3 | PULSE SETTING 3 FOR PRELIMINARY DISCHARGE |
| Level4 | PULSE SETTING 4 FOR PRELIMINARY DISCHARGE |
| Level5 | PULSE SETTING 5 FOR PRELIMINARY DISCHARGE |
| Level6 | PULSE SETTING 6 FOR PRELIMINARY DISCHARGE |
| Level7 | PULSE SETTING 7 FOR PRELIMINARY DISCHARGE |
| Level8 | PULSE SETTING 8 FOR PRELIMINARY DISCHARGE |
| Level9 | PULSE SETTING 9 FOR PRELIMINARY DISCHARGE |
| Level10 | PULSE SETTING 10 FOR PRELIMINARY DISCHARGE |
| Level11 | PULSE SETTING 11 FOR PRELIMINARY DISCHARGE |
| Level12 | PULSE SETTING 12 FOR PRELIMINARY DISCHARGE |
| Level13 | PULSE SETTING 13 FOR PRELIMINARY DISCHARGE |
| Level14 | PULSE SETTING 14 FOR PRELIMINARY DISCHARGE |
| Level15 | PULSE SETTING 15 FOR PRELIMINARY DISCHARGE |

FIG. 23B

| | |
|---|---|
| Level0 | PULSE SETTING 0 FOR PRINTING |
| Level1 | PULSE SETTING 1 FOR PRINTING |
| Level2 | PULSE SETTING 2 FOR PRINTING |
| Level3 | PULSE SETTING 3 FOR PRINTING |
| Level4 | PULSE SETTING 4 FOR PRINTING |
| Level5 | PULSE SETTING 5 FOR PRINTING |
| Level6 | PULSE SETTING 6 FOR PRINTING |
| Level7 | PULSE SETTING 7 FOR PRINTING |
| Level8 | PULSE SETTING 8 FOR PRINTING |
| Level9 | PULSE SETTING 9 FOR PRINTING |
| Level10 | PULSE SETTING 10 FOR PRINTING |
| Level11 | PULSE SETTING 11 FOR PRINTING |
| Level12 | PULSE SETTING 12 FOR PRINTING |
| Level13 | PULSE SETTING 13 FOR PRINTING |
| Level14 | PULSE SETTING 14 FOR PRINTING |
| Level15 | PULSE SETTING 15 FOR PRINTING |

PRINTING APPARATUS AND METHOD OF JUDGING NOZZLE DISCHARGE STATE OF PRINTING APPARATUS

BACKGROUND OF THE INVENTION

Field of the Invention

The present invention relates to a printing apparatus and a method of judging the nozzle discharge state of the printing apparatus and particularly to, for example, a printing apparatus for executing printing by transferring, to a print medium, an image formed by discharging ink from a printhead to a transfer member, and a method of judging the nozzle discharge state of the printing apparatus.

Description of the Related Art

Conventionally, there is known an inkjet printing apparatus for printing an image on a print medium by discharging ink droplets from a printhead. For the printing apparatus having this arrangement, there is proposed a technique of inspecting the discharge state of each ink discharge nozzle (to be referred to as a nozzle hereinafter) provided in the printhead using ink droplet discharge from the printhead.

Japanese Patent Laid-Open No. 2008-000914 discloses a technique in which when a printhead including a plurality of nozzles and heaters corresponding to the nozzles is used, a change in temperature of each heater when driving each heater by applying pulse to the heater is monitored and the discharge state of each nozzle is judged based on the presence/absence of the inflection point of the change in temperature.

However, according to the examinations of the inventors, in a method of judging a discharge state by driving an element to discharge ink, if inspection is executed by driving the element under the same drive conditions as those for the element when printing an image, sufficient accuracy may not be obtained.

SUMMARY OF THE INVENTION

Accordingly, the present invention is conceived as a response to the above-described disadvantages of the conventional art.

For example, a printing apparatus and a method of judging the nozzle discharge state of the printing apparatus according to this invention are capable of precisely performing inspection on a discharge state from a nozzle of a printhead.

According to one aspect of the present invention, there is provided a printing apparatus comprising: a printhead including a plurality of nozzles each configured to discharge ink and a plurality of sensors, corresponding to the plurality of nozzles, for detecting a discharge state of ink from the plurality of nozzles; a print unit configured to print, based on print data, an image by driving the printhead under a first drive condition to discharge ink from the printhead to a first area, and discharge ink to a second area different from the first area by driving the printhead, based on inspection data, under a second drive condition different from the first drive condition; and a judgement unit configured to judge a discharge state of each of the plurality of nozzles, based on an output from each of the plurality of sensors at a timing of driving the printhead by the print unit under the second drive condition.

According to another aspect of the present invention, there is provided a method of judging a nozzle discharge state of a printing apparatus having a printhead including a plurality of nozzles each configured to discharge ink and a plurality of sensors, corresponding to the plurality of nozzles, for detecting a discharge state of ink from the plurality of nozzles, the method comprising: printing, based on print data, an image by driving the printhead under a first drive condition to discharge the ink from the printhead to a first area; discharging ink to a second area different from the first area by driving the printhead, based on inspection data, under a second drive condition different from the first drive condition; and judging a discharge state of each of the plurality of nozzles based on an output from each of the plurality of sensors at a timing of driving the printhead under the second drive condition.

The invention is particularly advantageous since it is possible to precisely perform inspection on a discharge state from a nozzle of a printhead.

Further features of the present invention will become apparent from the following description of exemplary embodiments (with reference to the attached drawings).

BRIEF DESCRIPTION OF THE DRAWINGS

FIG. 14 is a table showing a specific example of an inspection pattern;

FIGS. 23A and 23B are tables each showing the structure of a drive pulse table;

DESCRIPTION OF THE EMBODIMENTS

Exemplary embodiments of the present invention will now be described in detail in accordance with the accompanying drawings. Note that in each drawing, arrows X and Y indicate horizontal directions perpendicular to each other, and an arrow Z indicates an up/down direction.

Description of Terms

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component, however, it is assumed that this embodiment uses water-base ink including water, resin, and pigment serving as coloring material.

Further, a "print element" generically means an ink orifice or a nozzle including a liquid channel communicating with it, and a discharge element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing System>

Figure 1:
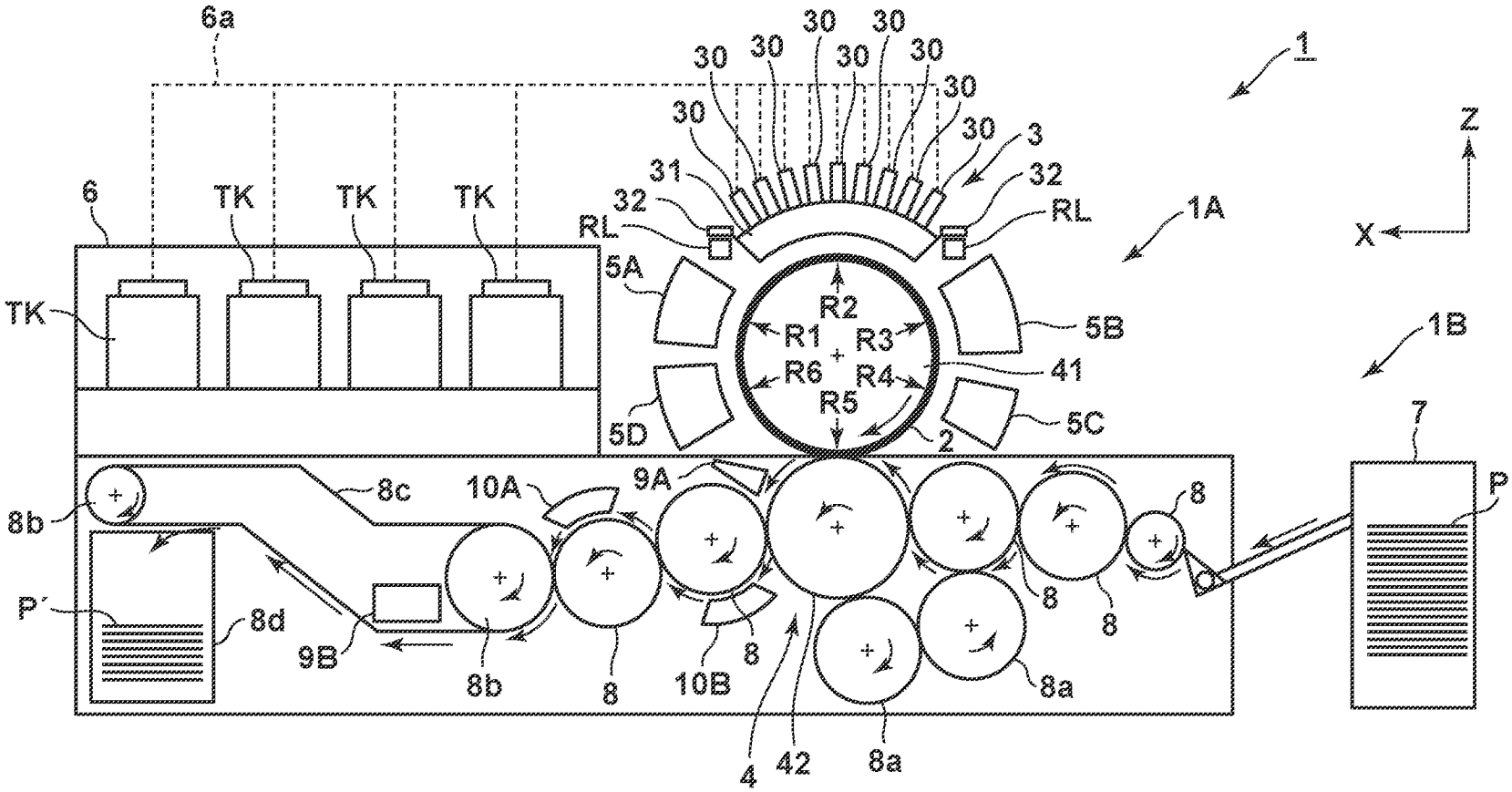
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

<Printing Apparatus>

The printing apparatus 1A includes a print unit 3, a transfer unit 4, peripheral units 5A to 5D, and a supply unit 6.

<Print Unit>

Figure 2:
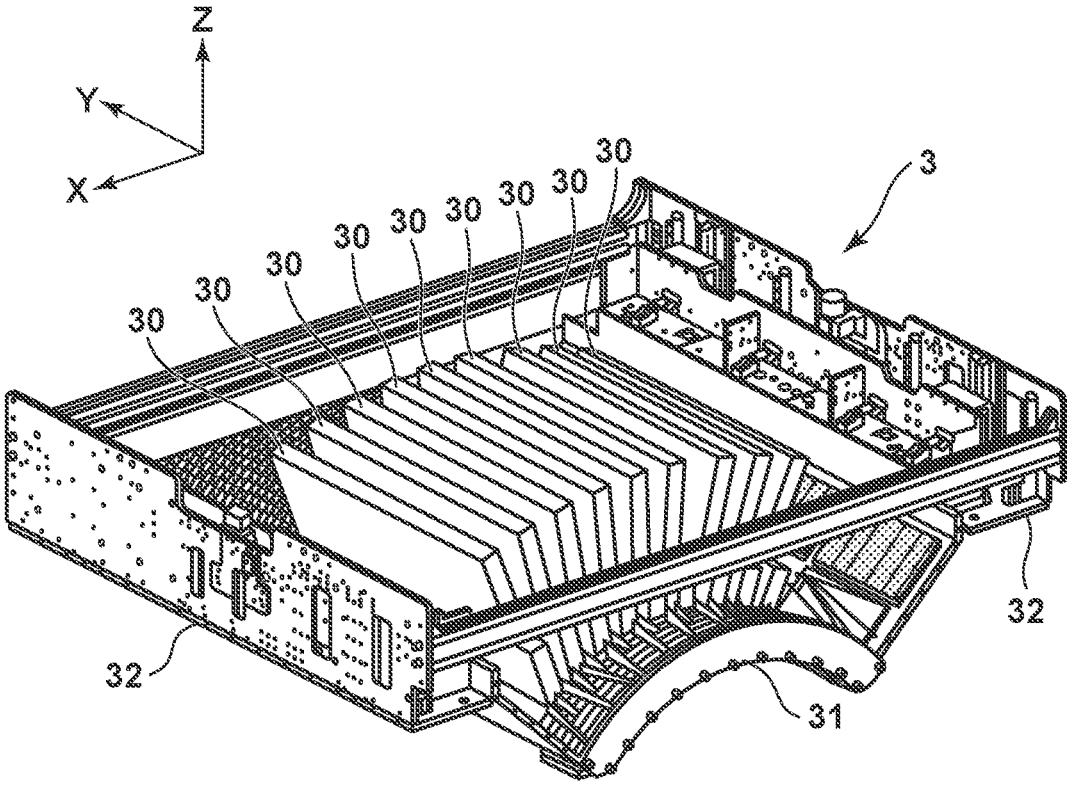
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge colorless ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
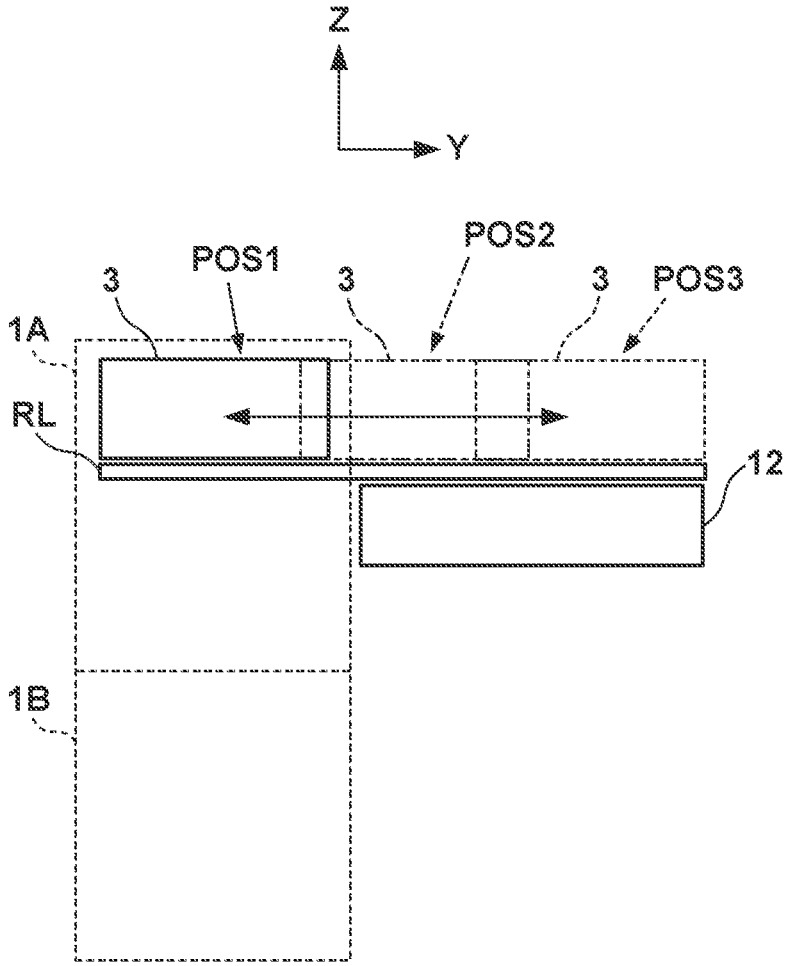
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, and a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprone rubber, urethane rubber, nitrile rubber, and the like can given. In addition, ethylene propylene rubber, natural rubber, styrene rubber, isoprene rubber, butadiene rubber, the copolymer of ethylene/propylene/butadience, nitrile-butadiene rubber, and the like call be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer the elastic layer and between the elastic layer and the compressed layer, varios adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that drives them. A driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves (stores) ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing include, for example, coating that aims at protection, providing glossiness, and the like of an image on the image printed surface of the printed product P'. For example, liquid application, sheet welding, lamination, and the like can be given as examples of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
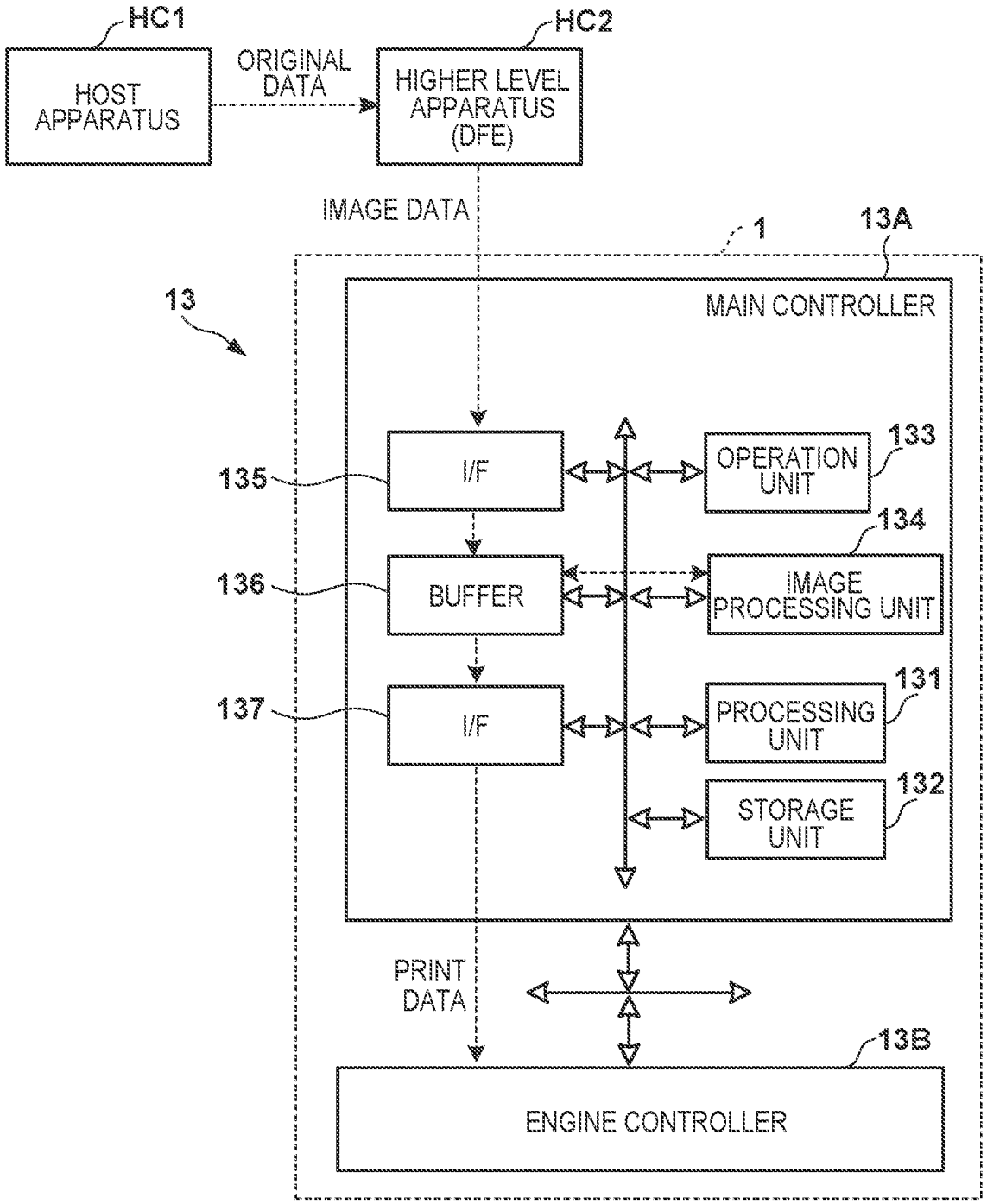
FIG. 4 is a block diagram showing a control system of the printing system in FIG. 1.
Figure 5:
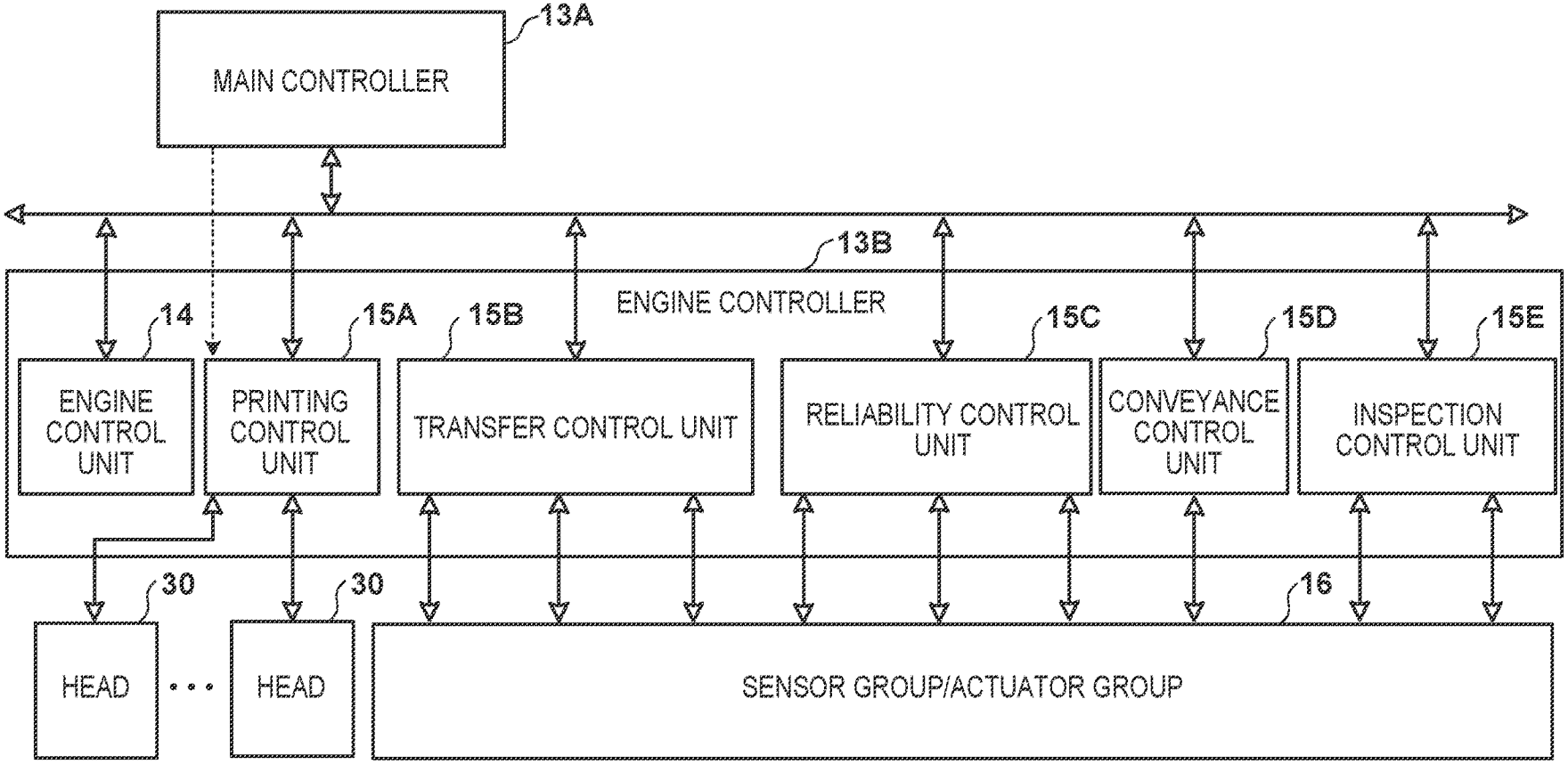
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a PC (Personal Computer) serving as an information processing apparatus, or a server apparatus. A communication method between the host apparatus HC1 and the higher level apparatus HC2 may be, without particular limitation, either wired or wireless communication.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. An external storage unit may further be provided in addition to the storage unit 132. The operation unit 133 is, for example, an input device such as a touch panel, a keyboard, or a mouse and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes engine control units 14 and to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

<Operation Example>

Figure 6:
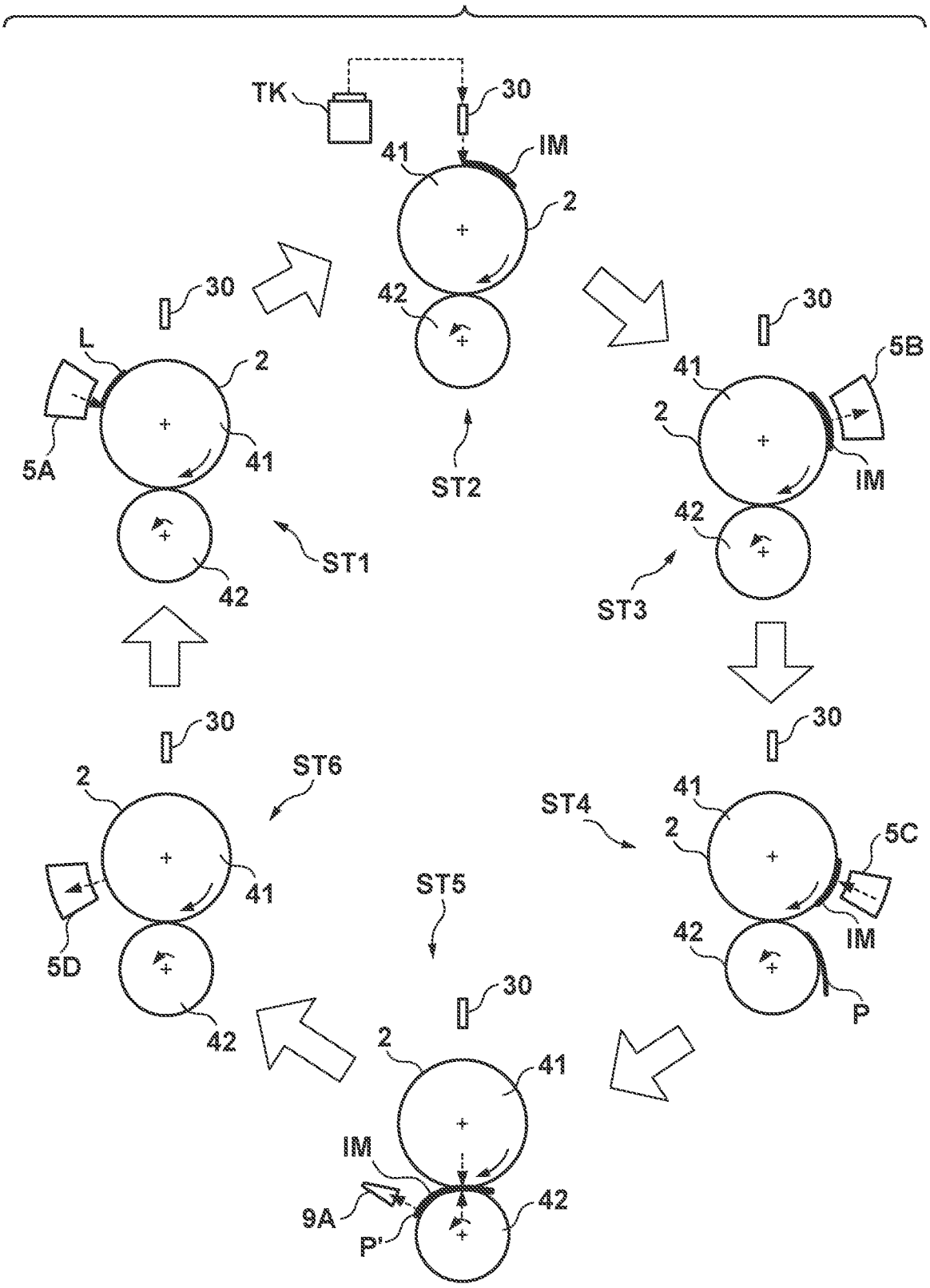
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
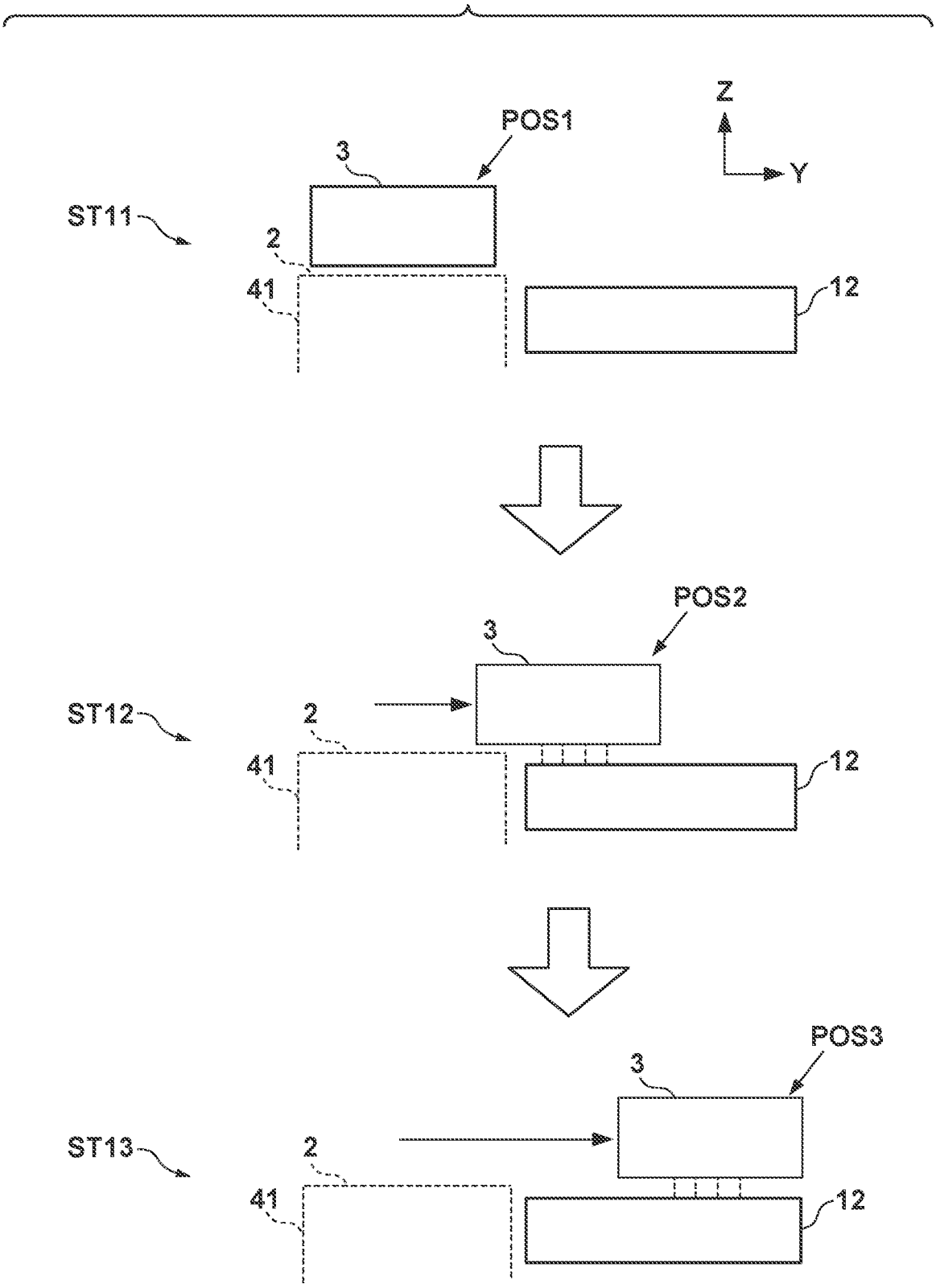
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

<Description of Detailed Arrangement of Printhead (FIGS. 8A to 9)>

Figure 8A:
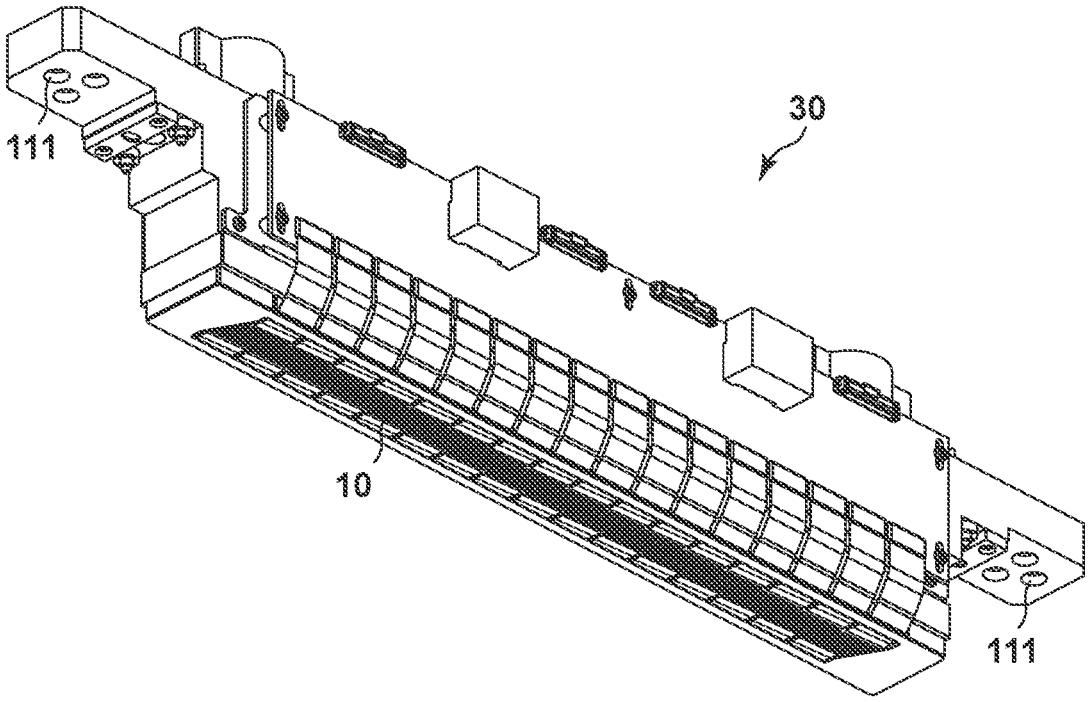
FIGS. 8A and 8B are perspective views each showing the arrangement of the printhead.
Figure 8B:
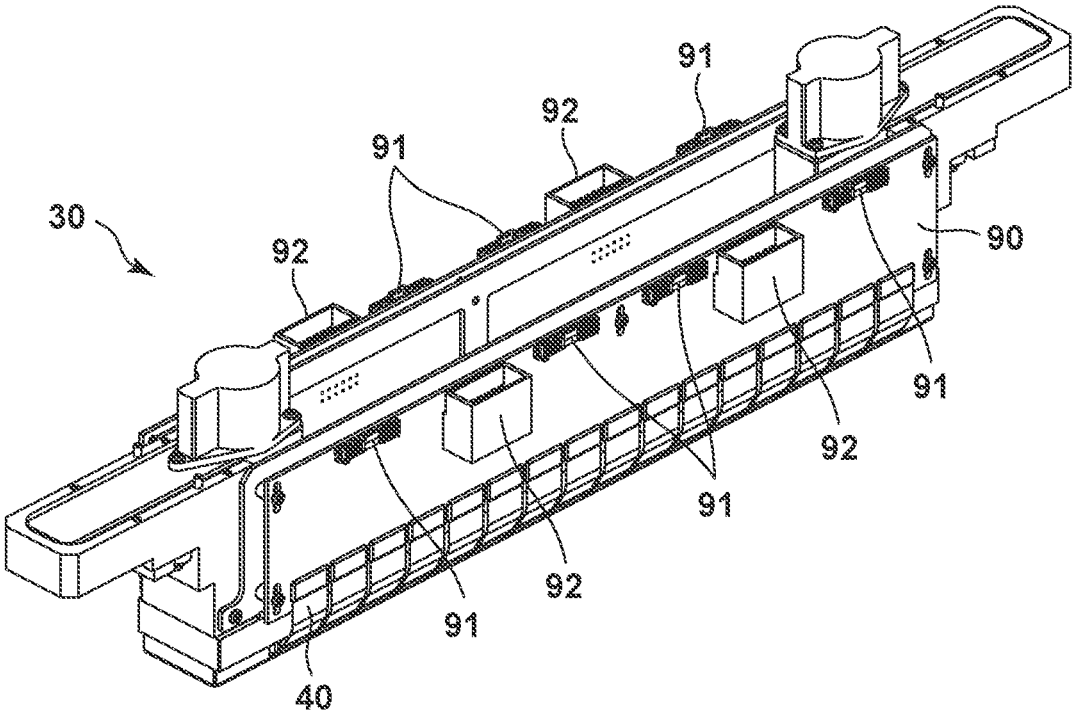

FIGS. 8A and 8B are perspective views each showing the arrangement of the printhead 30.

FIG. 8A is the perspective view showing the printhead 30 when viewed from an obliquely downward direction. FIG. 8B is the perspective view showing the printhead 30 when viewed from an obliquely upward direction.

The printhead 30 is a full-line printhead that arrays a plurality of element substrates 10 each capable of discharging one-color ink on a line (arranges them in line) and has a print width corresponding to the width of a print medium.

As shown in FIG. 8A, connection portions 111 provided in two end portions of the printhead 30 are connected to an ink supplying mechanism of the printing apparatus. Consequently, ink is supplied from the ink supplying mechanism to the printhead 30, and the ink that has passed through the printhead 30 is collected to the ink supplying mechanism. Thus, the ink can circulate via a channel of the ink supplying mechanism and a channel of the printhead 30.

As shown in FIG. 8B, the printhead 30 includes signal input terminals 91 electrically connected to the respective element substrates 10 and flexible wiring substrates 40 via an electric wiring substrate 90, and electric supply terminals 92. The signal input terminals 91 and the electric supply terminals 92 are electrically connected to the printing control unit 15A of the printing apparatus, and supply driving signals and power needed for discharge, respectively, to the element substrates 10. It is possible to reduce the number of signal input terminals 91 and electric supply terminals 92 as compared with the number of element substrates 10 by aggregating wirings with an electric circuit in the electric wiring substrate 90. This can reduce the number of electrical connection portions that need to be detached when the printhead 30 is attached to the print unit 3, or the printhead 30 is replaced.

Note that in this embodiment, an ink circulation type printhead in which ink between an inside of a nozzle and an outside of the nozzle is circulated so as to suppress an increase of ink viscosity is used. However, a conventional ink consumption type printhead without an ink circulation mechanism may be used.

If a plurality of head chips are arranged in a predetermined direction to form a full-line printhead with a longer print width while having a uniform nozzle pitch, a joint is created between the head chips. To effectively use all nozzles integrated in the head chips, this embodiment adopts the head chips each having a parallelogram shape.

Figure 9:
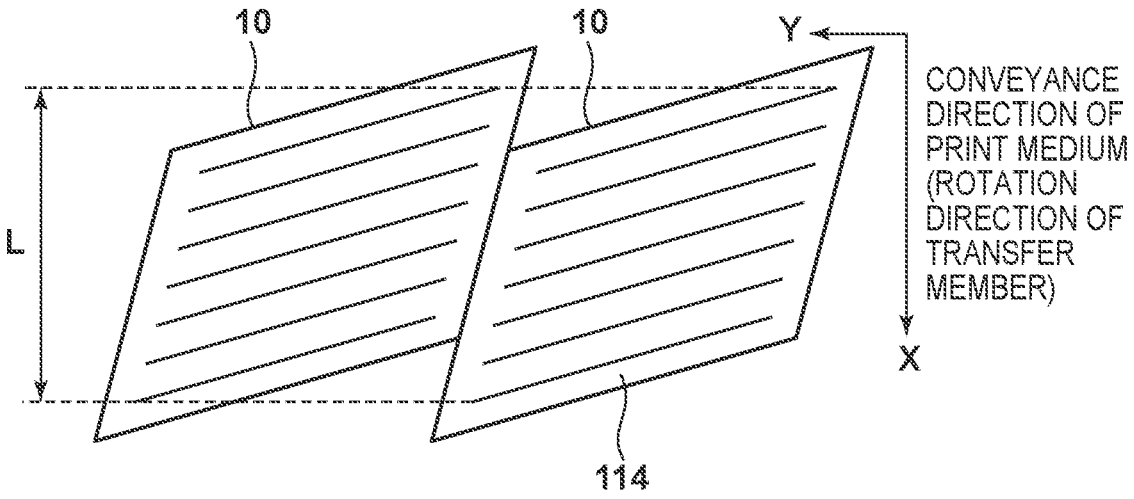
FIG. 9 is a view showing the connection arrangement of parallelogram-shaped head chips (head substrates)

FIG. 9 is a view showing the connection arrangement of parallelogram-shaped head chips (head substrates).

FIG. 9 shows only an example of connecting the two head chips (head substrates) 10. As shown in FIG. 9, however, a long print width is achieved by connecting the plurality of head substrates 10.

Each head chip includes a plurality of nozzle arrays 114, as shown in FIG. 9. The plurality of nozzle arrays are arranged with an angle so that nozzle array directions are directions intersecting the conveyance direction of the print medium (the rotation direction of the transfer member). Therefore, there is a distance L in the conveyance direction of the print medium between a leading end nozzle and a tail end nozzle of a nozzle array. Furthermore, each nozzle array is formed from a plurality of nozzles, and a heater that applies heat energy to ink and a temperature sensor that measures the temperature of the heater are provided in each nozzle. Each head substrate has a multilayer structure, and a corresponding temperature sensor is provided immediately below each heater in a layer different from that in which each heater is provided.

Therefore, a drive pulse is input to each heater of each head chip forming the printhead, and a change in temperature of each heater is monitored based on an output from the temperature sensor corresponding to each heater, thereby making it possible to judge the discharge state of each nozzle based on the change characteristic.

An arrangement of inspecting the discharge state of each nozzle of the printhead 30 in the printing system having the above-described arrangement will be described next.

<Explanation of Inspection of Nozzle Discharge State of Printhead>

Explanation of Arrangement of Temperature Detection Element (FIGS. 19A to 19C)>

Figure 19C:
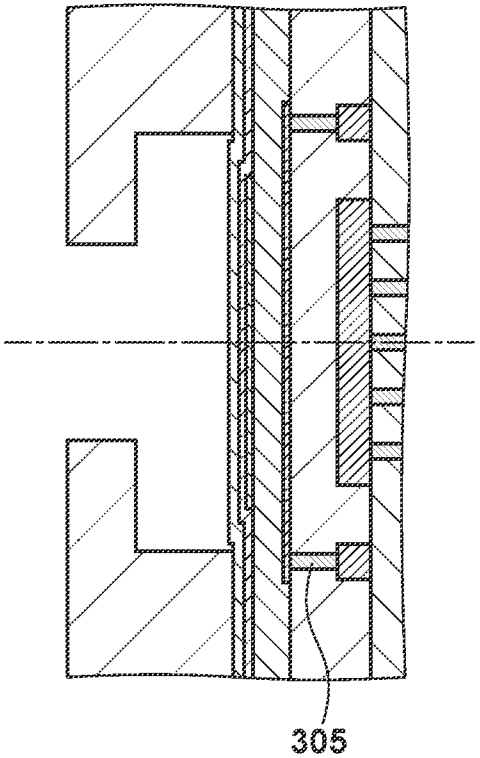
FIGS. 19A, 19B, and 19C are views each showing a multilayer wiring structure near a print element formed on an element substrate.
Figure 19A:
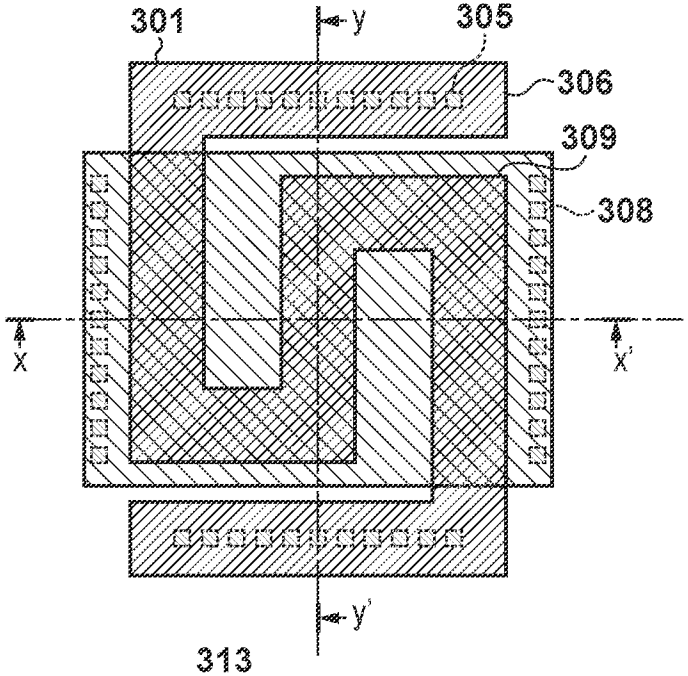
Figure 19B:
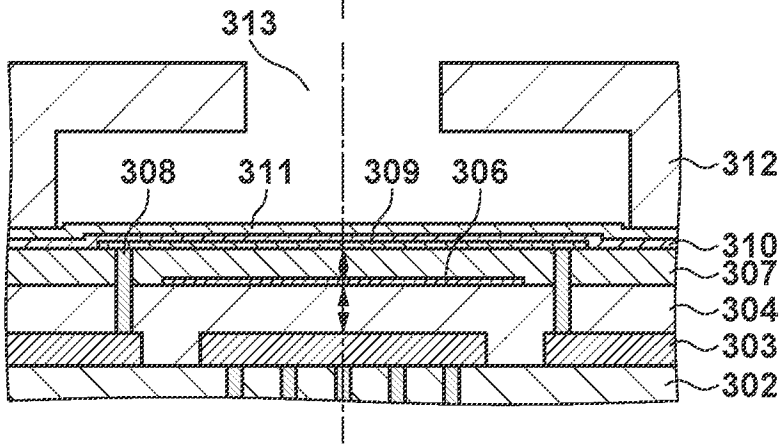

FIGS. 19A to 19C are views each showing the multilayer wiring structure near a print element formed on an element substrate.

FIG. 19A is a plan view showing a state in which a temperature detection element 306 is arranged in the form of a sheet in a layer below a print element 309 via an interlayer insulation film 307, and schematically showing a perspective view of the print element 309 and its periphery when viewed in a direction from the orifice 313 to the print element 309. FIG. 19B is a sectional view taken along a broken line x-x' in the plan view shown in FIG. 19A. FIG. 19C is a sectional view taken along a broken line y-y' shown in FIG. 19A.

In the x-x' sectional view shown in FIG. 19B and the y-y' sectional view shown in FIG. 19C, a wiring 303 made of aluminum or the like is formed on an insulation film 302 layered on the silicon substrate, and an interlayer insulation film 304 is further formed on the wiring 303. The wiring 303 and the temperature detection element 306 serving as a thin film resistor formed from a layered film of titanium and titanium nitride or the like are electrically connected via conductive plugs 305 which are embedded in the interlayer insulation film 304 and made of tungsten or the like.

Next, the interlayer insulation film 307 is formed below the temperature detection element 306. The wiring 303 and the print element 309 serving as a heating resistor formed by a tantalum silicon nitride film or the like are electrically connected via conductive plugs 308 which penetrate through the interlayer insulation film 304 and the interlayer insulation film 307, and made of tungsten or the like.

Note that when connecting the conductive plugs in the lower layer and those in the upper layer, they are generally connected by sandwiching a spacer formed by an intermediate wiring layer. When applied to this embodiment, since the film thickness of the temperature detection element serving as the intermediate wiring layer is as small as about several ten nm, the accuracy of overetching control with respect to a temperature detection element film serving as the spacer is required in a via hole process. In addition, the thin film is also disadvantageous in pattern miniaturization of a temperature detection element layer. In consideration of this situation, in this embodiment, the conductive plugs which penetrate through the interlayer insulation film 304 and the interlayer insulation film 307 are employed.

To ensure the reliability of conduction in accordance with the depths of the plugs, in this embodiment, each conductive plug 305 including one interlayer insulation film has a bore of 0.4 μm, and each conductive plug 308 in which the interlayer insulation film penetrates the two films has a larger bore of 0.6 μm.

Next, a head substrate (element substrate) is obtained by forming a protection film 310 such as a silicon nitride film, and then forming an anti-cavitation film 311 that contains tantalum or the like on the protection film 310.

Furthermore, an orifice 313 is formed by a nozzle forming material 312 containing a photosensitive resin or the like.

As described above, the multilayer wiring structure in which an independent intermediate layer of the temperature detection element 306 is provided between the layer of the wiring 303 and the layer of the print element 309 is employed.

With the above arrangement, in the element substrate used in this embodiment, it is possible to obtain, for each print element, temperature information by the temperature detection element provided, in correspondence with each print element, immediately below the print element.

Based on the temperature information detected by the temperature detection element and a change in temperature, a logic circuit (inspection unit) provided in the element substrate can obtain a determination result signal RSLT indicating the status of ink discharge from the corresponding print element. The determination result signal RSLT is a 1-bit signal, and "1" indicates normal discharge and "0" indicates a discharge failure.

<Explanation of Temperature Detection Arrangement (FIG. 20)>

Figure 20:
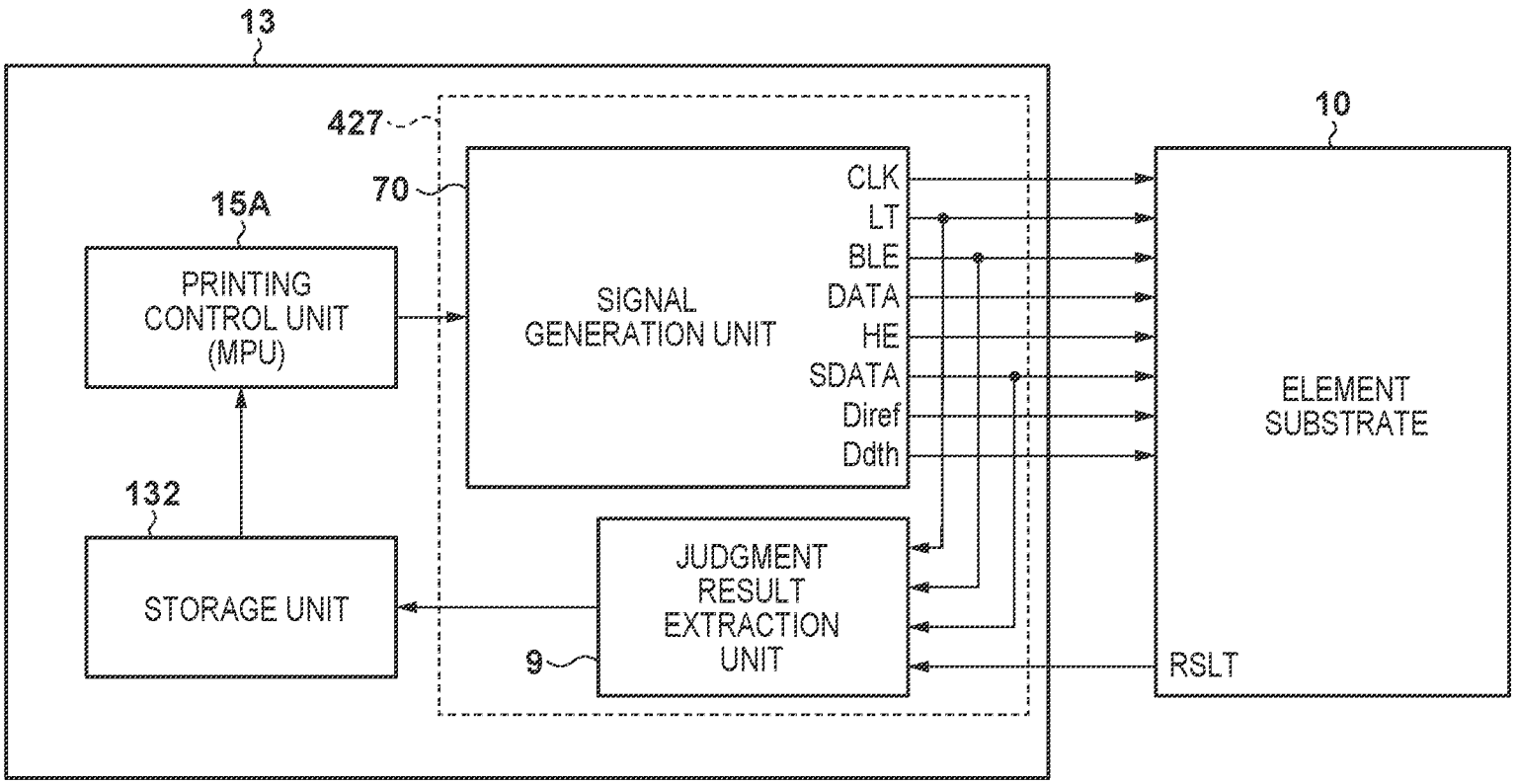
FIG. 20 is a block diagram showing a temperature detection control arrangement using the element substrate shown in FIGS. 19A, 19B, and 19C.

FIG. 20 is a block diagram showing a temperature detection control arrangement using the element substrate shown in FIGS. 19A to 19C.

As shown in FIG. 20, to detect the temperature of the print element integrated in an element substrate 10, the control unit 13 includes the printing control unit 15A integrating the MPU, the head I/F 427 for connection to the printhead 30, and the storage unit 132. Furthermore, the head I/F 427 includes a signal generation unit 70 that generates various signals to be transmitted to the element substrate 10, and a judgment result extraction unit 9 that receives the judgment result signal RSLT output from the element substrate 10 based on the temperature information detected by the temperature detection element 306.

For temperature detection, when the printing control unit 15A issues an instruction to the signal generation unit 70, the signal generation unit 70 outputs a clock signal CLK, a latch signal LT, a block signal BLE, a print data signal DATA, and a heat enable signal HE to the element substrate 10. The signal generation unit 70 also outputs a sensor selection signal SDATA, a constant current signal Diref, and a discharge inspection threshold signal Ddth.

The discharge inspection threshold signal Ddth is configured to set a threshold for a print element group in which the plurality of print elements integrated in the printhead 30 are divided into a plurality of groups each formed from a plurality of print elements located close to each other, and to change the setting value in one column cycle. In this embodiment, this group will be referred to as a discharge inspection threshold setting group hereinafter. For the sake of descriptive convenience, assume that the number of print elements integrated in the printhead 30 is 256, and a threshold voltage (TH) for discharge inspection is settable for each of 16 groups each formed from 16 print elements located close to each other.

Note that an arrangement in which a unique threshold voltage for discharge inspection is settable for each of all the print elements or an arrangement in which a setting value is changeable for each latch is possible. However, in such arrangement, the circuit scale of the head I/F 427 increases, and a significant increase in cost cannot be avoided. To solve this problem, this embodiment adopts an arrangement in which a threshold voltage (TH) for discharge inspection is settable for each group.

The sensor selection signal SDATA includes selection information for selecting the temperature detection element to detect the temperature information, energization quantity designation information to the selected temperature detection element, and information pertaining to an output instruction of the judgment result signal RSLT. If, for example, the element substrate 10 is configured to integrate five print element arrays each including a plurality of print elements, the selection information included in the sensor selection signal SDATA includes array selection information for designating an array and print element selection information for designating a print element of the array. On the other hand, the element substrate 10 outputs the 1-bit judgment result signal RSLT based on the temperature information detected by the temperature detection element corresponding to the one print element of the array designated by the sensor selection signal SDATA.

Note that this embodiment employs an arrangement in which the 1-bit judgment result signal RSLT is output for the print elements of the five arrays. Therefore, in an arrangement in which the element substrate 10 integrates 10 print element arrays, the judgment result signal RSLT is a 2-bit signal, and this 2-bit signal is serially output to the judgment result extraction unit 9 via one signal line.

As is apparent from FIG. 20, the latch signal LT, the block signal BLE, and the sensor selection signal SDATA are fed back to the judgment result extraction unit 9. On the other hand, the judgment result extraction unit 9 receives the judgment result signal RSLT output from the element substrate 10 based on the temperature information detected by the temperature detection element, and extracts a judgment result during each latch period in synchronism with the fall of the latch signal LT. If the judgment result indicates a discharge failure, the block signal BLE and the sensor selection signal SDATA corresponding to the judgment result are stored in the storage unit 132.

The printing control unit 15A erases a signal for the discharge failure nozzle from the print data signal DATA of a corresponding block based on the block signal BLE and the sensor selection signal SDATA which have been used to drive the discharge failure nozzle and stored in the storage unit 132. The printing control unit 15A adds a nozzle for complementing a non-discharge nozzle to the print data signal DATA of the corresponding block instead, and outputs the signal to the signal generation unit 70.

<Explanation of Discharge State Judgment Method (FIG. 21)>

Figure 21:
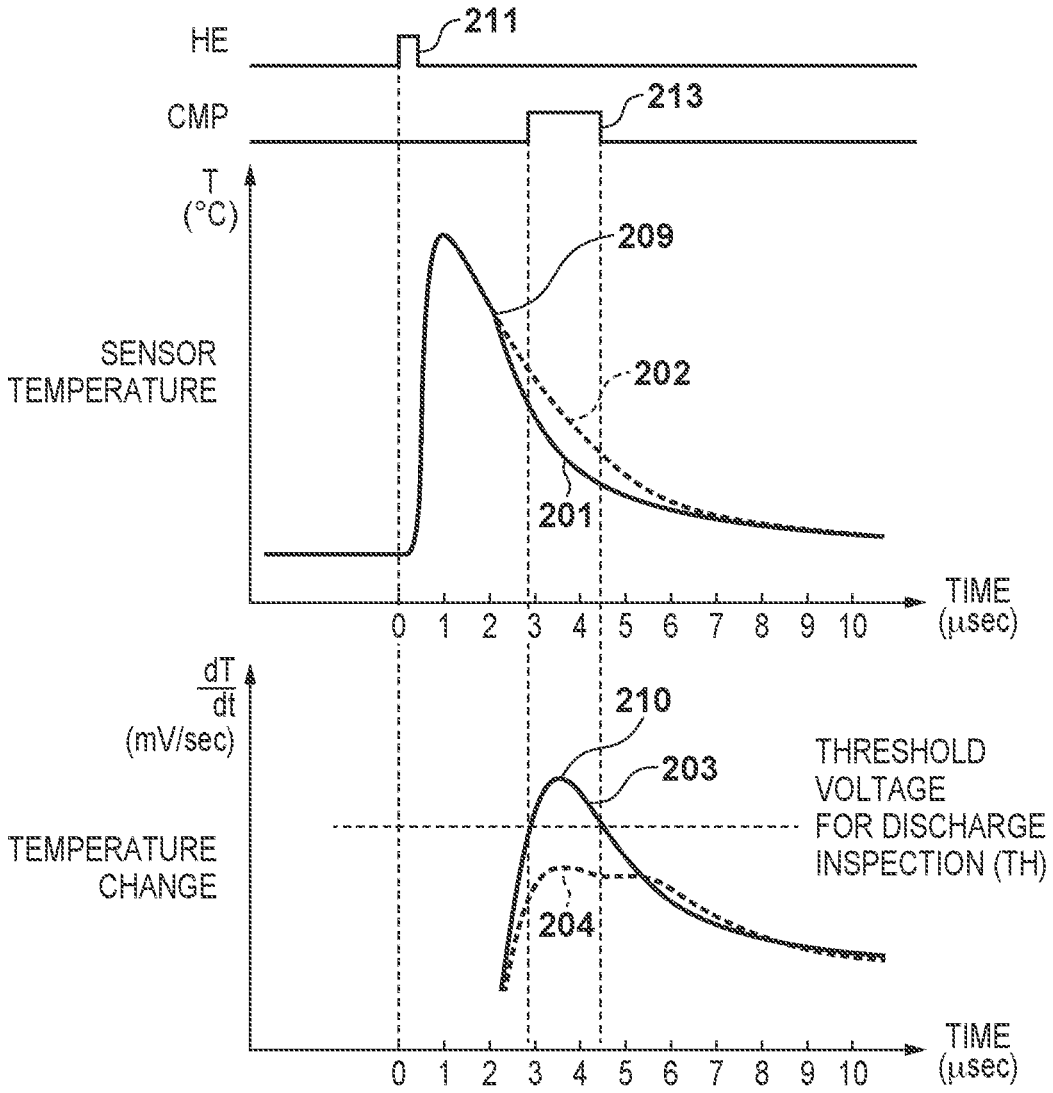
FIG. 21 is a view showing a temperature waveform (sensor temperature: T) output from a temperature detection element and a temperature change signal (dT/dt) of the waveform when applying a drive pulse to the print element.

FIG. 21 is a view showing a temperature waveform (sensor temperature: T) output from a temperature detection element and a temperature change signal (dT/dt) of the waveform when applying a drive pulse to the print element.

Note that in FIG. 21, the temperature waveform (sensor temperature: T) is represented by a temperature (° C.). In fact, a constant current is supplied to the temperature detection element and a voltage (V) between the terminals of the temperature detection element is detected. Since this detected voltage has temperature dependence, the detected voltage is converted into a temperature and indicated as the temperature in FIG. 21. The temperature change signal (dT/dt) is indicated as a temporal change (mV/sec) in detected voltage.

As shown in FIG. 21, if ink is discharged normally when a driving pulse 211 is applied to the print element 309 (normal discharge), a waveform 201 is obtained as the output waveform of the temperature detection element 306. In a temperature drop process of the temperature detected by the temperature detection element 306, which is represented by the waveform 201, a feature point 209 appears when the tail (satellite) of an ink droplet discharged from the print element 309 drops to the interface of the print element 309 and cools the interface at the time of normal discharge. After the feature point 209, the waveform 201 indicates that the temperature drop rate increases abruptly. On the other hand, at the time of a discharge failure, a waveform 202 is obtained as the output waveform of the temperature detection element 306. Unlike the waveform 201 at the time of normal discharge, no feature point 209 appears, and the temperature drop rate gradually decreases in a temperature drop process.

The lowermost timing chart of FIG. 21 shows the temperature change signal (dT/dt), and a waveform 203 or 204 represents a waveform obtained after processing the output waveform 201 or 202 of the temperature detection element into the temperature change signal (dT/dt). A method of performing conversion into the temperature change signal at this time is appropriately selected in accordance with a system. The temperature change signal (dT/dt) according to this embodiment is represented by a waveform output after the temperature waveform is processed by a filter circuit (one differential operation in this arrangement) and an inverting amplifier.

In the waveform 203, a peak 210 deriving from the highest temperature drop rate after the feature point 209 of the waveform 201 appears. The waveform (dT/dt) 203 is compared with a discharge inspection threshold voltage (TH) preset in a comparator integrated in the element substrate 10, and a pulse indicating normal discharge in a period (dT/dt≥TH) in which the waveform 203 exceeds the discharge inspection threshold voltage (TH) appears in a judgment signal (CMP) 213.

On the other hand, since no feature point 209 appears in the waveform 202, the temperature drop rate is low, and the peak appearing in the waveform 204 is lower than the discharge inspection threshold voltage (TH). The waveform (dT/dt) 202 is also compared with the discharge inspection threshold voltage (TH) preset in the comparator integrated in the element substrate 10. In a period (dT/dt<TH) in which the waveform 202 is below the discharge inspection threshold voltage (TH), no pulse appears in the judgment signal (CMP) 213.

Therefore, by obtaining this judgment signal (CMP), it is possible to grasp the discharge state of each nozzle. This judgment signal (CMP) serves as the above-described judgment result signal RSLT.

Figure 10:
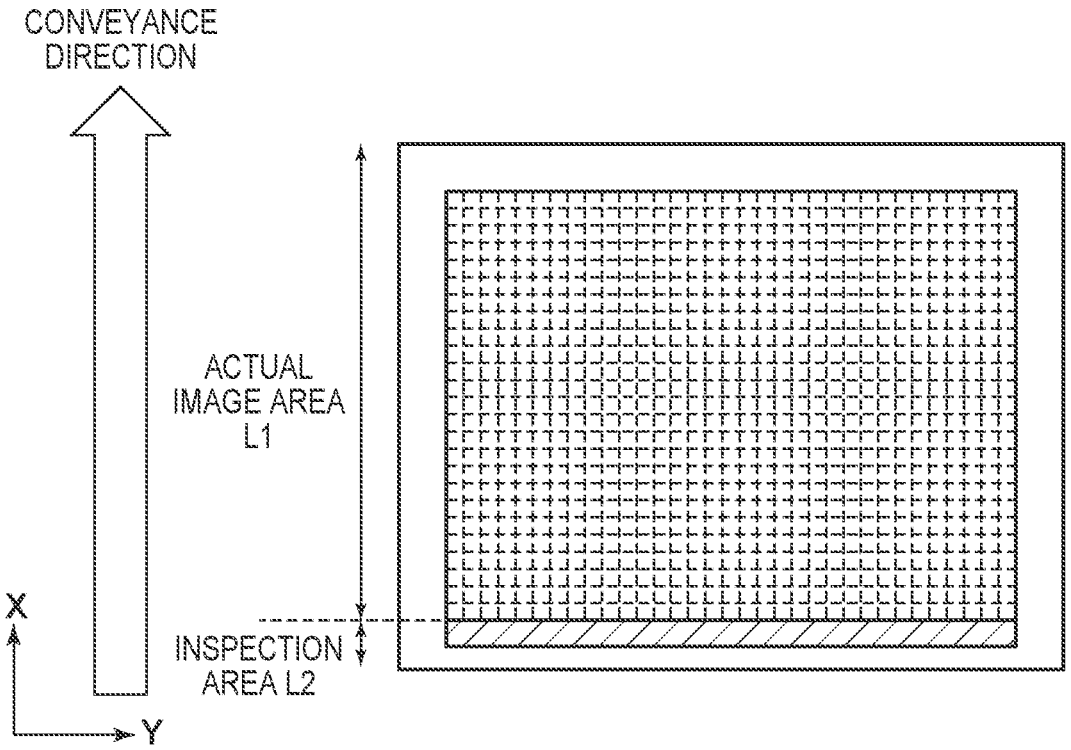
FIG. 10 is a view showing an area (actual image area) where an image is actually printed on a print medium and an inspection area used to inspect the discharge state of each nozzle of a printhead.

FIG. 10 is a view showing an area (actual image area) where an image is actually printed on the print medium and an inspection area used to inspect the discharge state of each nozzle of the printhead.

In the printing system 1, an image is formed on the transfer member 2 by ink discharged from the printhead 30, and the image is transferred from the transfer member 2 to the print medium P. Therefore, an actual image area L1 and an inspection area L2 shown in FIG. 10 can also be said to be provided on the transfer member 2.

The above-described printing control unit 15A sets the actual image area L1 and the inspection area L2 on the print medium P (or the transfer member 2) based on information of an image size and a paper size set by the user. The printing control unit 15A switches over between a drive pulse used to drive each heater for printing the image in the actual image area L1 and a drive pulse used to drive each heater for inspecting the discharge state of each nozzle of the printhead 30 using the inspection area L2. That is, the printing control unit 15A starts the operation of a counter from the leading end of the print medium with respect to the conveyance direction of the print medium during a print operation, and switches over the drive pulse based on the information of the actual image area L1 in accordance with a timing after printing of lines the number of which corresponds to the actual image area L1.

Figure 11:
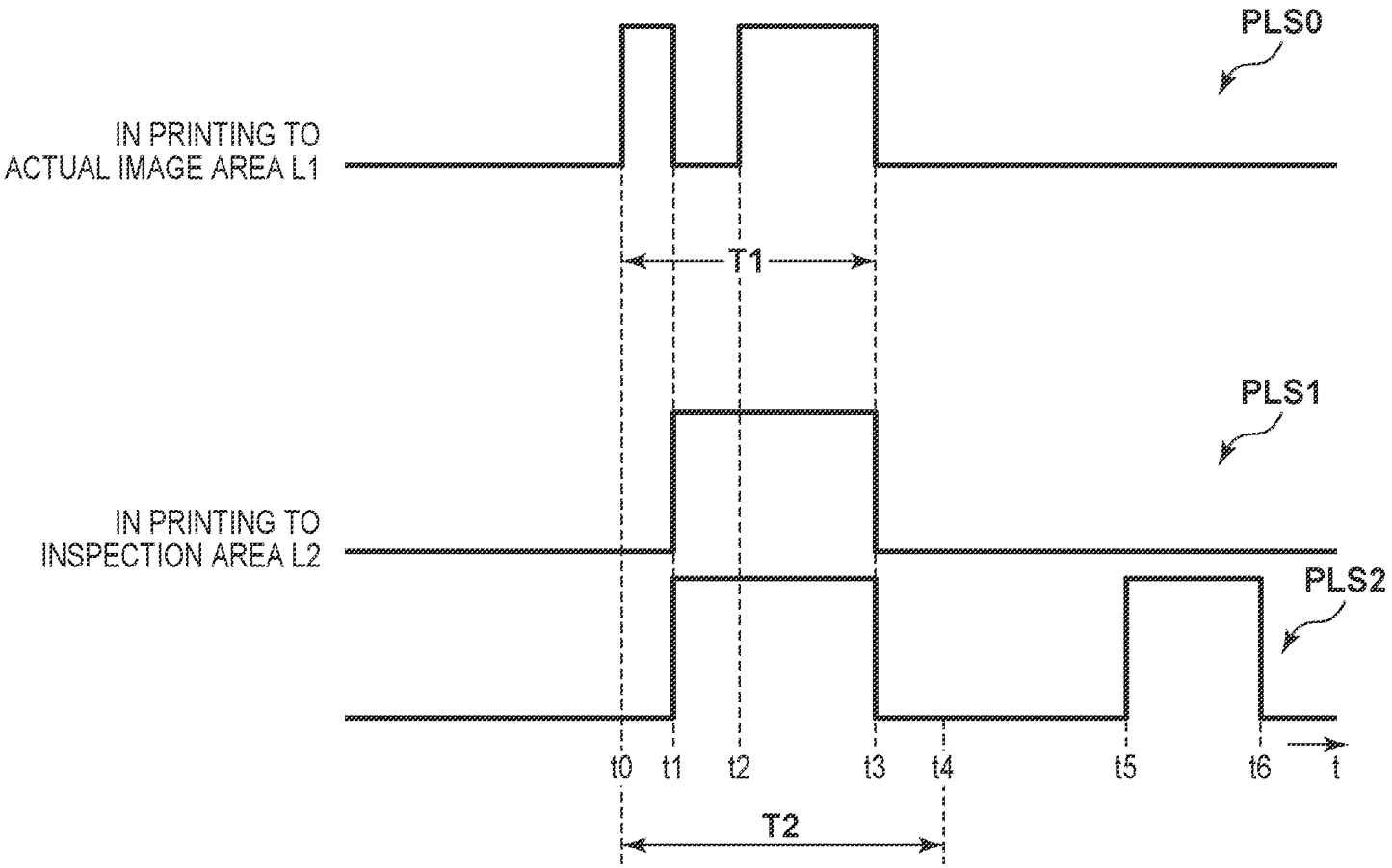
FIG. 11 is a timing chart showing the arrangements of drive pulses each used to drive each heater of the printhead.

FIG. 11 is a timing chart showing the arrangements of drive pulses each used to drive each heater of the printhead.

Referring to FIG. 11, PLS0 represents a drive pulse used when the printhead 30 executes printing in the actual image area L1 (printing mode), and PLS1 and PLS2 respectively represent drive pulses used when the printhead 30 inspects the discharge state of each nozzle using the inspection area L2 (inspection mode). The printing control unit 15A switches over between the printing mode and the inspection mode during a print operation, that is, between the drive pulses by switching over a drive pulse table (to be described later) as a table indicating a drive pulse, thereby driving the heater of each nozzle of the printhead 30.

As shown in FIG. 11, a drive pulse that makes a discharge speed lower than the speed of printing in the actual image area is selected as the drive pulse used for the inspection mode. For example, the drive pulse PLS0 with a double-pulse arrangement is used for printing in the actual image area L1 and the drive pulse PLS1 with a pulse width of a single-pulse arrangement is used for printing in the inspection area L2, thereby decreasing the discharge speed.

When printing the actual image area, the time during which a droplet floats is advantageously shortened since the droplet can be accurately adhered at a target position. Therefore, a drive pulse is applied so as to increase the kinetic energy of ink. On the other hand, in the inspection mode, since the principle of cooling the interface of the print element 309 when the satellite of an ink droplet drops is used, the kinetic energy of ink is decreased to facilitate a drop of the satellite on the interface of the print element 309. The pulse has the feature in which the speed can be suppressed while maintaining the energy by applying the drive pulse PLS1 as a single pulse during a time almost equal to a time (t1−t0)+(t3−t2) during which the drive pulse PLS0 is applied. Note that to further suppress the speed, in fact, a single pulse may be used such that the time is slightly shorter than (t1−t0)+(t3−t2).

Furthermore, the drive pulse PLS2 can be used for printing in the inspection area L2. Although, similar to the drive pulse PLS1, the drive pulse PLS2 causes foaming as soon as an electric current of a single-pulse portion (T1) flows into the heater, so it is possible to improve the inspection accuracy by heating the heater by energizing a small pulse with a micro time difference (t5−t4).

Furthermore, in fact, a response speed becomes an issue. For example, a drive voltage to be applied to the heater may be changed. If, for example, heater warm-up control is executed, a heater warm-up temperature may be changed to a lower temperature.

In this embodiment, the discharge state of each nozzle can be inspected by switching over the operation mode of the printhead to the inspection mode after printing the image in the actual image area L1, and executing an ink discharge operation in the inspection area L2 using the drive pulse dedicated for inspection. At this time, the discharge state of each nozzle can be inspected while continuously operating the printing system without the need to stop rotation of the transfer member 2. Thus, while the printhead 30 forms an image in the actual image area L1 of the transfer member 2, that is, while the printhead operates in the printing mode, the operation of the temperature sensor is turned off, and then the operation mode of the printhead is switched over to the inspection mode when the ink discharge position of the printhead 30 enters the inspection area L2. The operation of the temperature sensor is turned on when the operation mode of the printhead 30 is switched over to the inspection mode, thereby monitoring a change in temperature of each heater.

Note that although the drive pulse is one of the drive conditions under which the printhead 30 is driven, a drive voltage, a head adjustment temperature, and like are also included in the drive conditions.

Figure 12A:
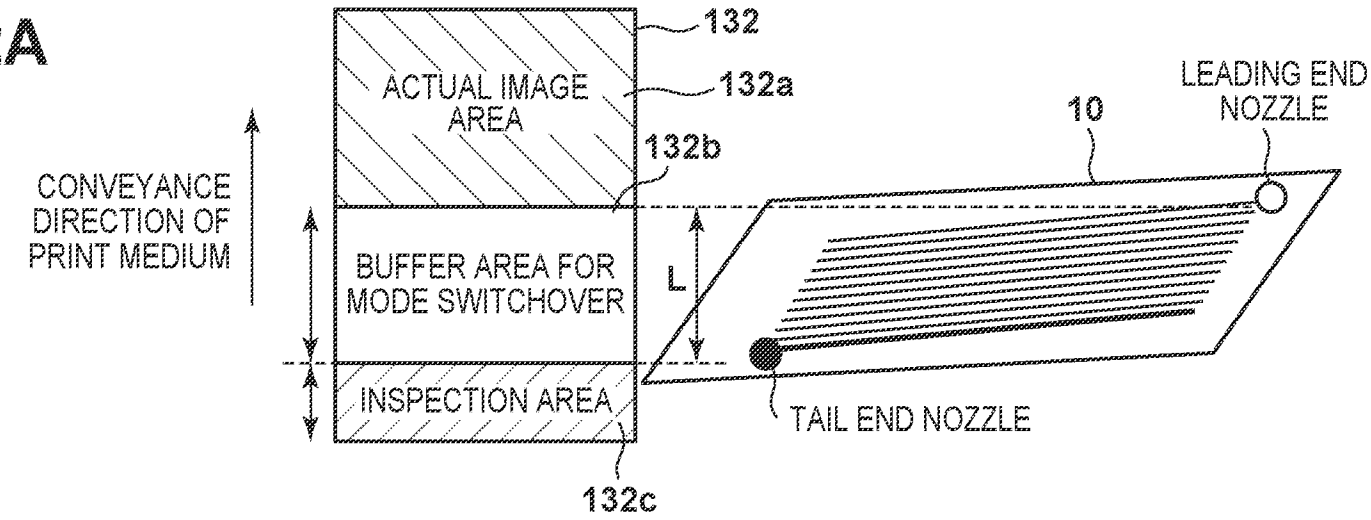
FIGS. 12A and 12B are views each showing the relationship between the head substrate and a print data storage area provided in a storage unit.
Figure 12B:
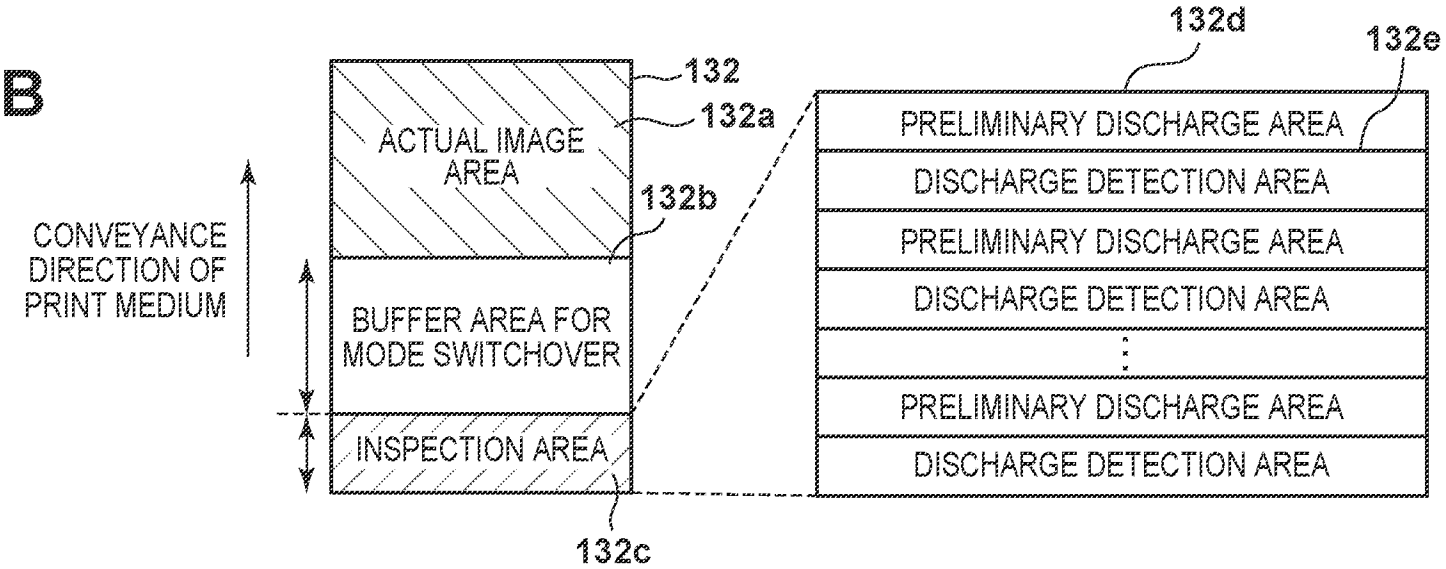

FIGS. 12A and 12B are views each showing the relationship between the head substrate and a print data storage area provided in the storage unit. FIG. 12A is a schematic view showing an actual image area, a mode switchover buffer area, and an inspection area in the print data storage area in correspondence with the positional relationship on the print medium (in this example, the transfer member 2). FIG. 12B is a view showing the detailed arrangement of an inspection area 132*c*. Note that FIG. 12B will be described later.

During a print operation, the transfer member 2 continuously rotates, and print data is continuously read out from the storage unit 132 to the printhead 30.

In this embodiment, a wiring of an electrical signal is provided so that a common drive pulse is applied to the heaters corresponding to the nozzles of each nozzle array 114 of the element substrate 10. Then, for one head substrate, the drive pulse of the printing mode or that of the inspection mode is input to all the elements. If such head substrate is used, it is not desirable to drive some elements with the drive pulse for the inspection mode when some nozzles of the head substrate have not ended ink discharge operations for printing.

On the other hand, as described with reference to FIG. 9, the nozzle array directions of the element substrate 10 intersect the conveyance direction of the print medium, and there is the distance L between the leading end nozzle and the tail end nozzle. If the positions of the nozzles shift from each other in the conveyance direction of the print medium, when switching over the printhead 30 from the printing mode to the inspection mode, it is necessary to switch over to the inspection mode after the nozzles of all the nozzle arrays end the ink discharge operations in the actual image area. On the other hand, in this embodiment, since the printing mode is switched over to the inspection mode while continuously operating the printing system, it is required to continuously drive the printhead 30 while performing a continuous data readout operation.

To cope with the continuous data readout operation, in this embodiment, the data storage area is set in the storage unit 132, as shown in FIG. 12A. That is, a data storage area (actual image area) 132*a* corresponding to the actual image area, a data storage area (inspection area) 132*c* corresponding to the inspection area, and a data storage area (buffer area) 132*b* corresponding to the mode switchover buffer area corresponding to the distance L between the actual image area 132*a* and the inspection area 132*c* are set. The continuous data readout operation is executed from an address in the storage area 132*a* of the storage unit 132 to an address in the storage area 132*c* through an address in the storage area 132*b* in synchronism with rotation of the transfer member 2, that is, a change in ink discharge position.

Note that with respect to each nozzle array 114 of the element substrate 10, a drive pulse may be settable for each nozzle array or each nozzle. In this case, while an actual image is printed using part of the same head substrate, the elements of a portion that has ended the print area of the actual image can be shifted to the inspection mode. In this way, the range, in the conveyance direction, of the mode switchover buffer area can be shortened.

Figure 13:
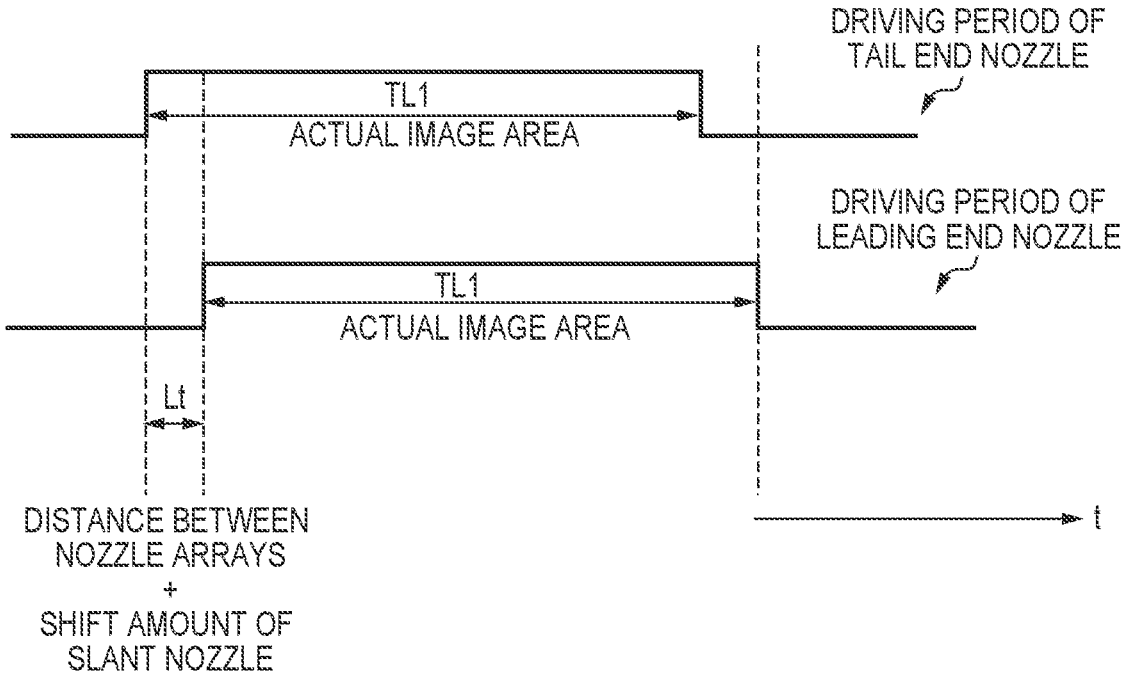
FIG. 13 is a timing chart showing a difference in driving interval between nozzles.

FIG. 13 is a timing chart showing a difference in driving interval between the nozzles.

Referring to FIG. 13, the upper portion shows the driving interval of the tail end nozzle shown in FIG. 12A, and the lower portion shows the driving interval of the leading end nozzle shown in FIG. 12A. As will be apparent by comparing these driving intervals, the times of the driving intervals of the nozzles are equal to each other, that is, TL1. However, since the nozzle arrays of the head substrate intersect the conveyance direction of the print medium, the drive start (drive end) timing of the nozzle (leading end nozzle) on the most downstream side is earlier than that of the nozzle (tail end nozzle) on the most upstream side with respect to the conveyance direction of the print medium. Referring to FIG. 13, Lt represents a time indicating a timing shift, and corresponds to the distance L shown in FIG. 12A.

Therefore, even if a print operation in the actual image area by the leading end nozzle has ended, a print operation in the actual image area by the tail end nozzle has not ended. Therefore, it is necessary to switch over the operation of the printhead from the printing mode to the inspection mode after the print operation in the actual image area by the tail end nozzle ends.

For the above reason, in a data readout operation, the timing shift is absorbed by providing the data storage area 132*b* corresponding to the mode switchover buffer area in the storage unit 132, as shown in FIG. 12A, and setting a data readout time for the area to a time equal to or longer than the time Lt shown in FIG. 13.

Since the influence of drying of a nozzle surface or the like can be reduced by performing a preliminary discharge operation before (if possible, immediately before) inspection in the inspection area, a time necessary for preliminary discharge is desirably considered to improve the judgement accuracy of the nozzle discharge state. In consideration of this, before all the nozzle arrays enter the inspection area, it is desirable to provide a buffer area of the same size and to perform a preliminary discharge operation in the buffer area.

As shown in FIG. 12B, a plurality of data of preliminary discharge areas 132*d* and a plurality of data of discharge detection areas 132*e* are stored in the inspection area 132*c*. Data to be used to inspect the presence/absence of discharge is stored in each discharge detection area 132*e*. Data to be used to perform a preliminary discharge operation immediately before detection of discharge in each discharge detection area 132*e* is stored in each preliminary discharge area 132*d*.

Figure 22:
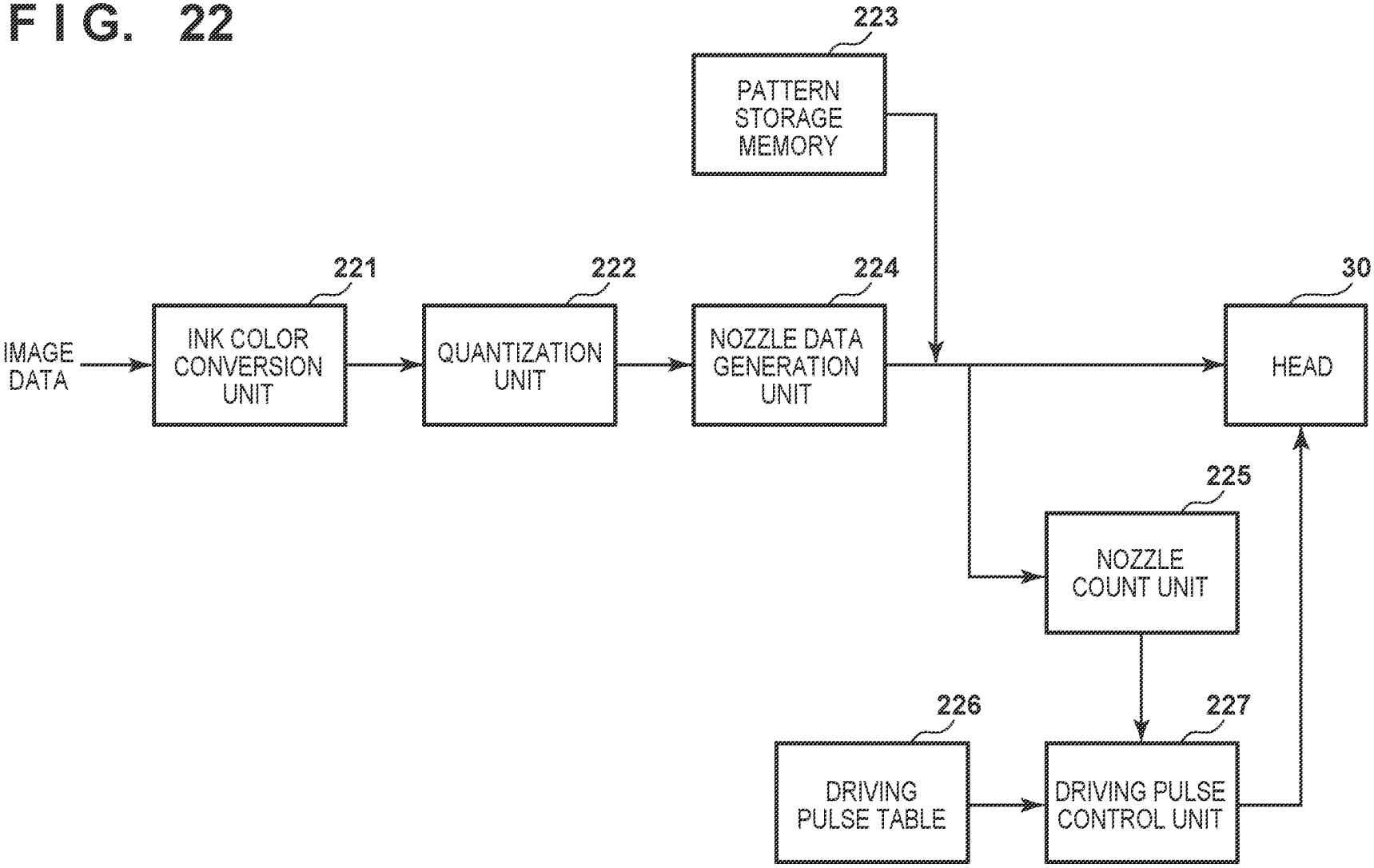
FIG. 22 is a block diagram showing the control arrangement of an inspection operation and a preliminary discharge operation.

FIG. 22 is a block diagram showing the control arrangement of an inspection operation and a preliminary discharge operation. The procedure of control of the inspection operation and the preliminary discharge operation will be described with reference to FIG. 22.

An ink color conversion unit 221 as part of the image processing unit 134 converts input image data from RGB data into ink color data. A quantization unit 222 as part of the image processing unit 134 quantizes the converted ink color data into print data. A nozzle data generation unit 224 of the printing control unit 15A allocates the quantized print data to each nozzle. The printhead 30 discharges ink in accordance with the nozzle data allocated to each nozzle.

The nozzle data allocated to each nozzle is input to a nozzle count unit 225 of the printing control unit 15A to count the number of nozzles that concurrently discharge ink at each discharge timing. The number of nozzles counted for each discharge timing is sent to a drive pulse control unit 227 of the printing control unit 15A. The drive pulse control unit 227 loads, from a drive pulse table 226 stored in a memory such as a ROM, a drive pulse setting corresponding to the number of nozzles counted by the nozzle count unit 225, and drives the printhead 30 at each discharge timing.

FIG. 23B is a table showing an example of a drive pulse table used when executing printing based on image data. Assume that the number of nozzles for switching over the level is 16 and the number of levels is 16. In this case, if the number of nozzles counted by the nozzle count unit 225 falls within the range of 1 to 16, pulse setting 0 for printing is selected, and if the number of nozzles falls within the range of 17 to 32, pulse setting 1 for printing is selected. As the number of nozzles that are concurrently driven is larger, a longer pulse width is set as a pulse for printing. As the number of nozzles that are concurrently driven is larger, a voltage for driving each head lowers. Thus, stable discharge independent of the number of nozzles that are concurrently driven is implemented by prolonging the pulse width for driving each head. The CPU sets the drive pulse table 226.

In this embodiment, the printhead 30 discharges ink based on a preliminary discharge pattern and a discharge detection pattern, instead of the image data. The preliminary discharge pattern is a pattern used to recover the status of a nozzle, and the discharge detection pattern is a pattern used to judge the discharge state of each nozzle. The preliminary discharge pattern and the discharge detection pattern are stored in a pattern storage memory 223 in a form of nozzle data. In this embodiment, the preliminary discharge pattern is a pattern in which the number of nozzles that concurrently discharge ink is always equal to or larger than 17, and the discharge detection pattern is a pattern in which the number of nozzles that concurrently discharge ink is always equal to or smaller than 16.

Similar to a case in which printing is executed based on image data, with respect to the preliminary discharge pattern and the discharge detection pattern, the nozzle count unit 225 counts the number of nozzles that concurrently discharge ink. The drive pulse control unit 227 selects a drive pulse table from the drive pulse table 226 in accordance with the number of nozzles counted by the nozzle count unit 225. As for the discharge detection pattern, the counted number is always equal to or smaller than 16. Therefore, a drive pulse table of level 0 is always selected. Furthermore, as for the preliminary discharge pattern, the counted number is always equal to or larger than 17, and therefore, a driving pulse table of one of levels 1 to 15 is selected.

FIG. 23A is a view showing an example of the drive pulse table when ink discharge is performed based on the preliminary discharge pattern and the discharge detection pattern. As shown in FIG. 23A, the drive pulse (PLS1 or PLS2) for discharge detection is set in a table of level 0, and the drive pulses for preliminary discharge are set in tables of levels 1 to 15. Note that the drive pulse for preliminary discharge may be the same as that for printing an actual image. This makes it possible to drive each head with the drive pulse for discharge detection when discharging ink using the discharge detection pattern and with the drive pulse for preliminary discharge when discharging ink using the preliminary discharge pattern without switching over the drive pulse table.

In the examples shown in FIGS. 12A and 12B, the image area (actual image area) 132*a*, the buffer area 132*b*, and the inspection area 132*c* are arranged in the storage unit 132. Printing is executed based on the image data stored in the image area 132*a* using the drive pulse table shown in FIG. 23B. As shown in FIG. 12B, the inspection area 132*c* is formed from the preliminary discharge areas 132*d* and the discharge detection areas 132*e*, and discharge is performed based on the patterns stored in these areas using the drive pulse table shown in FIG. 23B. More specifically, the preliminary discharge pattern is discharged based on the pattern stored in the preliminary discharge area 132*d* and the discharge detection pattern is discharged based on the pattern stored in the discharge detection area 132*e*.

Figure 25:
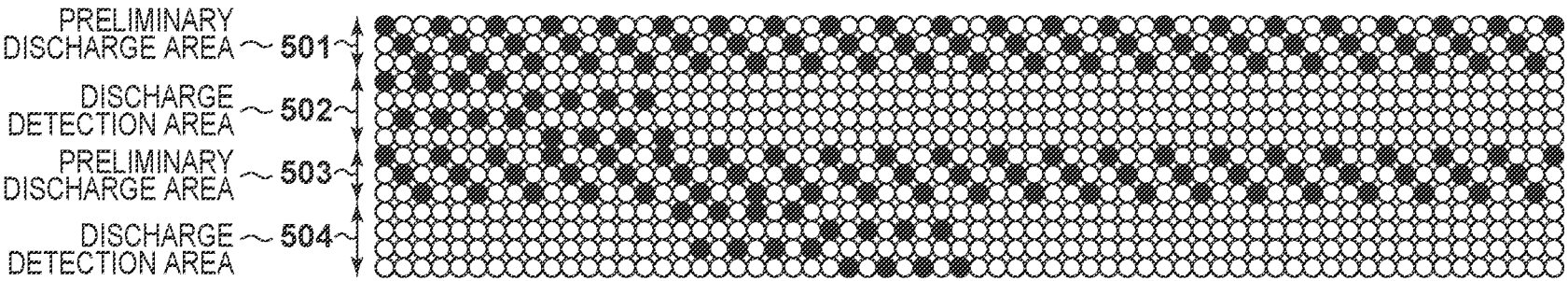
FIG. 25 is a view showing an example of printing of a discharge pattern corresponding to each nozzle, based on a pattern stored in the inspection area.

FIG. 25 is a view showing an example of printing of the discharge pattern corresponding to each nozzle based on the pattern stored in the inspection area 132*c*. In FIG. 25, each column represents each nozzle, and each row represents each discharge timing. Note that in FIG. 25, ● indicates a dot (discharge) where ink is discharged and ○ indicates a dot (non-discharge) where no ink is discharged. To improve the effect of preliminary discharge, preliminary discharge areas 501 and 503 and discharge detection areas 502 and 504 are alternately arranged in the inspection area on the print medium. Since the drive pulse table needs to be switched over between the image area and the inspection area, discharge of the head cannot be performed while the drive pulse table is switched over. Therefore, as shown in FIGS. 12A and 12B, the buffer area 132*b* for mode switchover in which no discharge of the head is performed is provided between the image area 132*a* and the inspection area 132*c*.

Figure 24A:
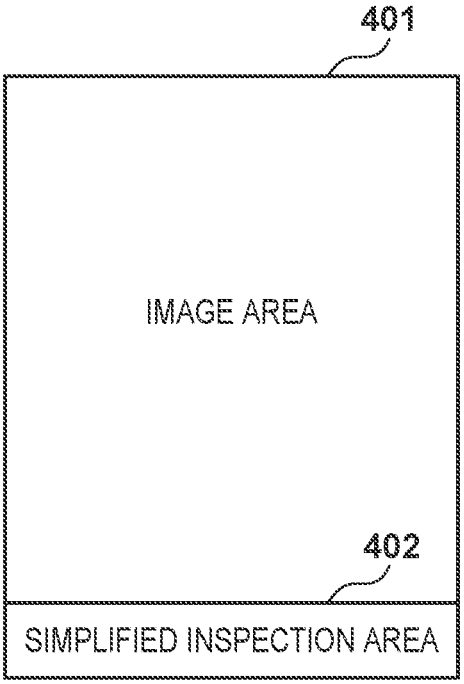
FIGS. 24A and 24B are views showing another example of an area where ink is discharged based on each data on the print medium.
Figure 24B:
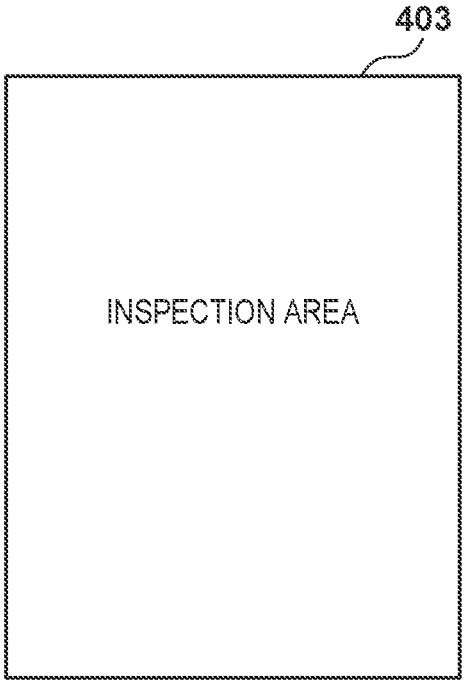

FIGS. 24A and 24B are views showing another example of the area where ink is discharged based on each data on the print medium. In this example, a page of the print medium formed by an image area 401 and a simplified inspection area 402, as shown in FIG. 24A, and a page of the print medium formed by only an inspection area 403, as shown in FIG. 24B, are included. Printing is executed in the image area 401 based on the image data stored in the image area 132*a* using the drive pulse table shown in FIG. 23B. Printing is executed in the simplified inspection area 402 based on the discharge detection pattern stored in the pattern storage memory 223 using the same drive pulse table as that used for the image data stored in the image area 132*a*. The discharge detection pattern and the preliminary discharge pattern stored in the pattern storage memory 223 are alternately printed in the inspection area 403 using the drive pulse table shown in FIG. 23A.

At the time of normal printing, the discharge state is simply judged based on page data with the arrangement shown in FIG. 24A. If it is necessary to accurately judge the discharge state, the discharge state is accurately judged using page data with the arrangement shown in FIG. 24B. At this time, it is necessary to switch over the drive pulse table between the pages. Furthermore, it is unnecessary to discharge the discharge detection pattern and the preliminary discharge pattern onto the print medium. The discharge state may be detected by discharging the discharge pattern shown in FIG. 25 onto a head cap, instead of printing the page with the arrangement shown in FIG. 24B.

Note that when executing preliminary discharge, it is desirable to perform the same registration adjustment as that used for printing in the actual image area in order to reduce an area necessary for the transfer member (print medium).

An inspection pattern used for inspection printing in the inspection area will be described next.

If a number of nozzles (heaters) are concurrently driven, this may highly probably adversely influence the inspection result of the discharge state of each nozzle. Thus, to improve the inspection accuracy, if an electric circuit of the same system is connected to a plurality of nozzle arrays, one nozzle is selectively caused to perform discharge.

FIG. 14 is a table showing a specific example of an inspection pattern.

The plurality of heaters integrated in the head substrate 10 are time-divisionally driven. FIG. 14 shows an example when 16 heaters are divided into eight blocks and time-divisionally driven. When performing inspection, for a nozzle (heater) having performed an ink discharge operation, a change in temperature of the heater is monitored, and each nozzle thus has time intervals for performing discharge and inspection.

In the example shown in FIG. 14, nozzle (Nzl) 0 performs discharge in block 0 of the first column, and is inspected in block 1 of the first column. Furthermore, nozzle (Nzl) 2 performs discharge in block 2 of the first column, and is inspected in block 3 of the first column.

Since the inspection time is different in accordance with the discharged ink and the circuit characteristic, as a matter of course, the nozzle driving order need not be limited to the example shown in FIG. 14. However, in inspection, print data is generated so that the number of nozzles which perform discharge in a cycle of discharge inspection becomes small. It is more desirable to generate inspection data for printing the inspection pattern in consideration of the physical positional shift of a nozzle and reduction of the occupied amount of the transfer member (print medium).

Figure 15:
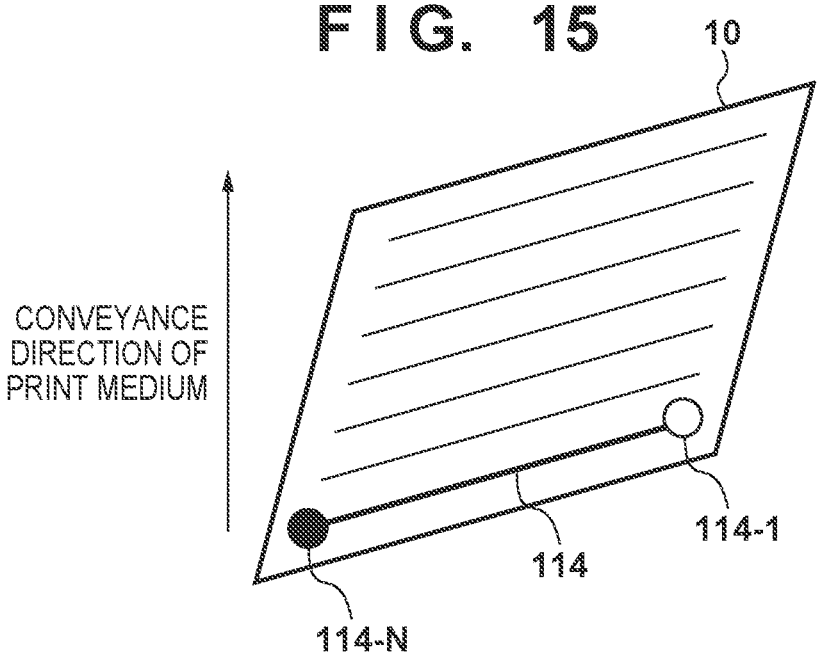
FIG. 15 is a view for explaining a nozzle driving order at the time of an inspection mode.

FIG. 15 is a view for explaining the nozzle driving order at the time of the inspection mode.

If the nozzle array shown in FIG. 15 is inspected, inspection printing is performed from a nozzle 114-1 on the downstream side to a nozzle 114-N on the upstream side with respect to the conveyance direction of the print medium. This is more desirable since it is possible to shorten the length, in the conveyance direction of the print medium, of the pattern of the inspection image formed on the transfer member 2, and reduce the occupied amount of the transfer member (print medium).

<Relationship between Inspection Mode Execution Portion and Double Side Printing>

The above description assumes that the inspection area is provided after the actual image area with respect to the conveyance direction of the print medium, as shown in FIG. 10, and the discharge state of each nozzle is inspected. The present invention, however, is not limited to this. For example, an inspection area may be provided before the actual image area with respect to the conveyance direction of the print medium or inspection areas may be provided before and after the actual image area with respect to the conveyance direction of the print medium.

Furthermore, since the printing system 1 can perform double side printing on the print medium P, inspection printing may be performed on the front surface or the back surface of the print medium.

Figure 16A:
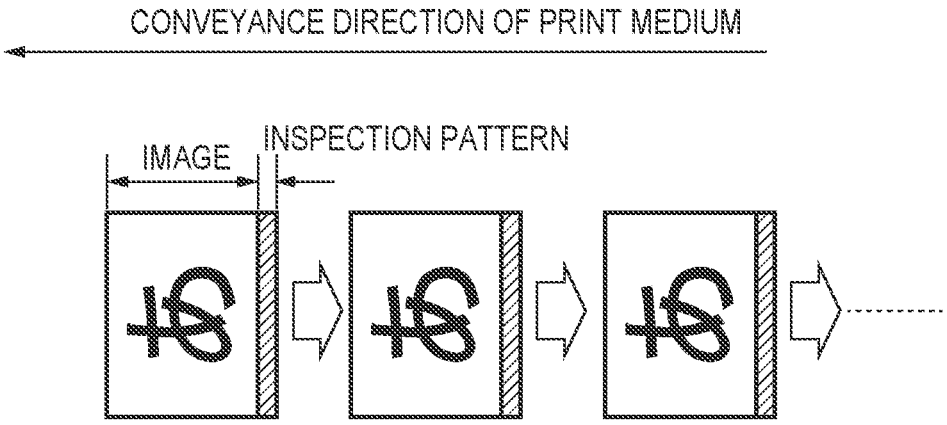
FIGS. 16A and 16B are views showing the relationship between double side printing and the inspection area where inspection printing is executed.
Figure 16B:
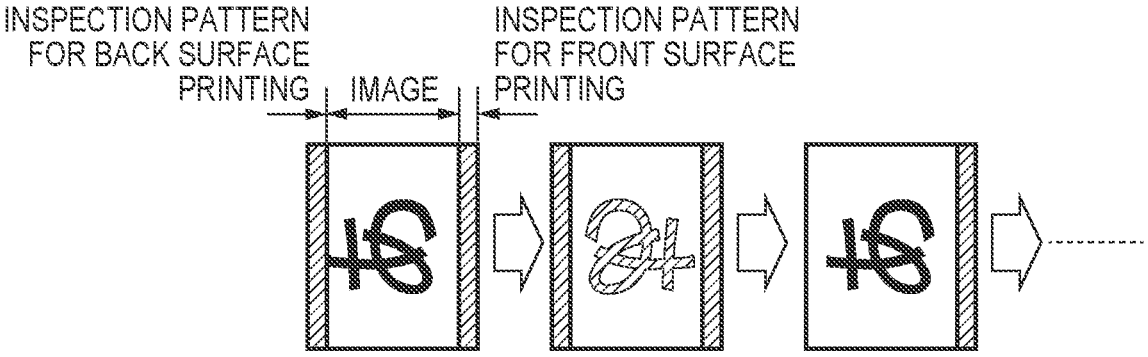

FIGS. 16A and 16B are views showing the relationship between double side printing and the inspection area where inspection printing is performed.

FIG. 16A shows a case in which the inspection area is provided on the tail end side (upstream side) of the actual image area with respect to the conveyance direction of the print medium at the time of single side printing. On the other hand, FIG. 16B shows a state in which an inspection image is printed at the time of double side printing. At the time of double side printing, the print medium is reversed after the end of front surface printing, and the reversed print medium is switched back to undergo back surface printing. Therefore, the inspection area set on the tail end side (upstream side) of the actual image area with respect to the conveyance direction of the print medium in front surface printing is located on the leading end side (downstream side) with respect to the conveyance direction of the print medium at the time of back surface printing. In this case, even if the inspection area is provided on the tail end side of the actual image area in front surface printing, it is necessary to also ensure the inspection area on the leading end side of the actual image area. If it is desirable to reduce the inspection area, the inspection area may be provided on the tail end side of the actual image area at the time of front surface printing and the inspection area may be provided on the leading end side of the actual image area at the time of back surface printing, or the inspection area may be provided only on one side at the time of double side printing.

If an image is formed on the transfer member 2 by discharging ink from the printhead 30, and then the formed image is transferred to the print medium, the size of the transfer member 2 is generally larger than the size of the print medium.

Figure 17:
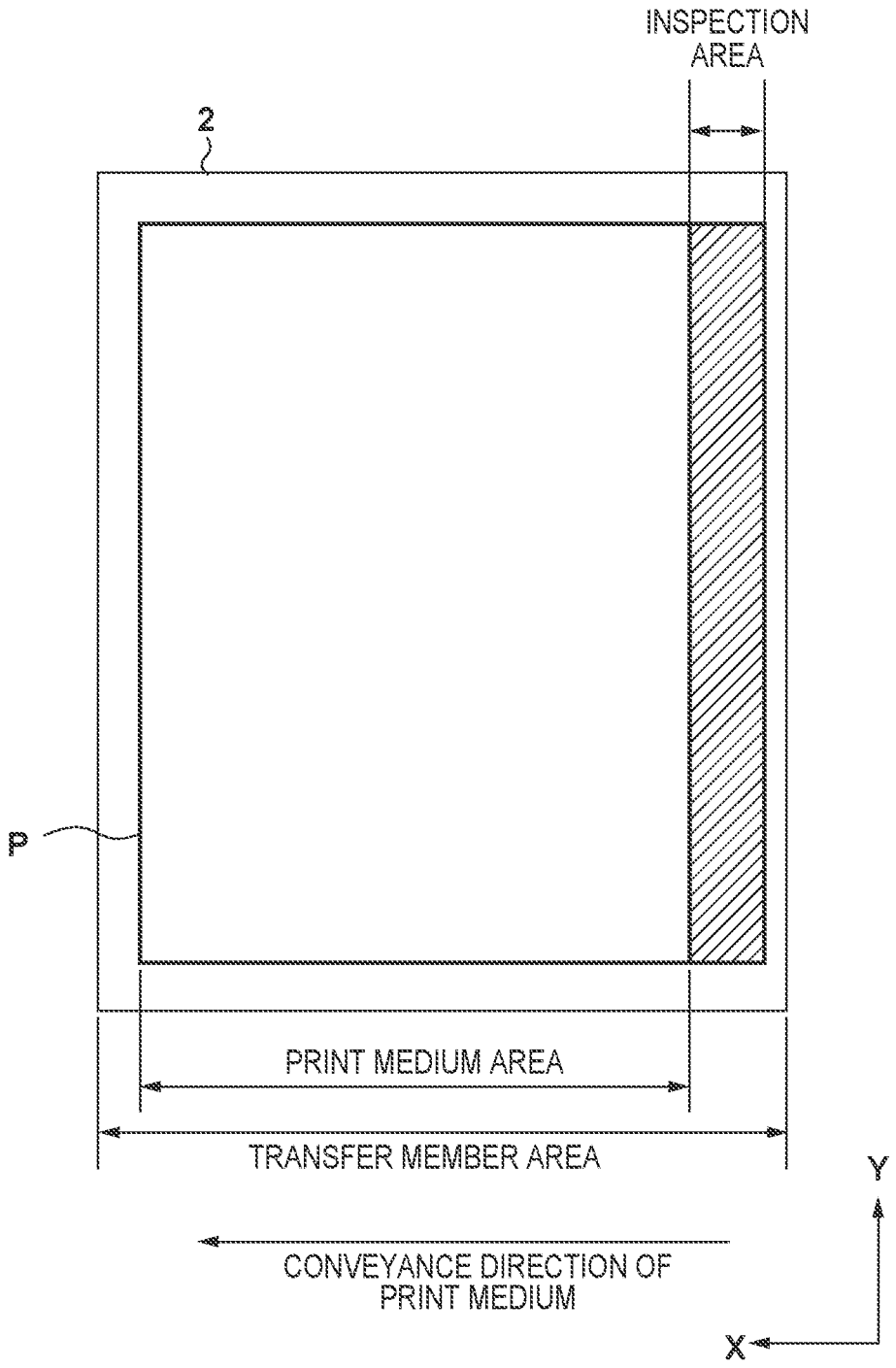
FIG. 17 is a view showing the relationship between the size of a transfer member and that of the print medium.

FIG. 17 is a view showing the relationship between the size of the transfer member and that of the print medium.

As shown in FIG. 17, by providing the inspection area in an area of the transfer member 2 outside the print medium P, the user can use the entire area of the print medium P for printing. In this case, however, ink discharged for inspection may contaminate the inside of the apparatus. Thus, the cleaning unit 5D needs to completely remove ink that has not been transferred to the print medium P.

Finally, the above-described processing of inspecting the nozzle discharge state will be described with reference to a flowchart.

Figure 18:
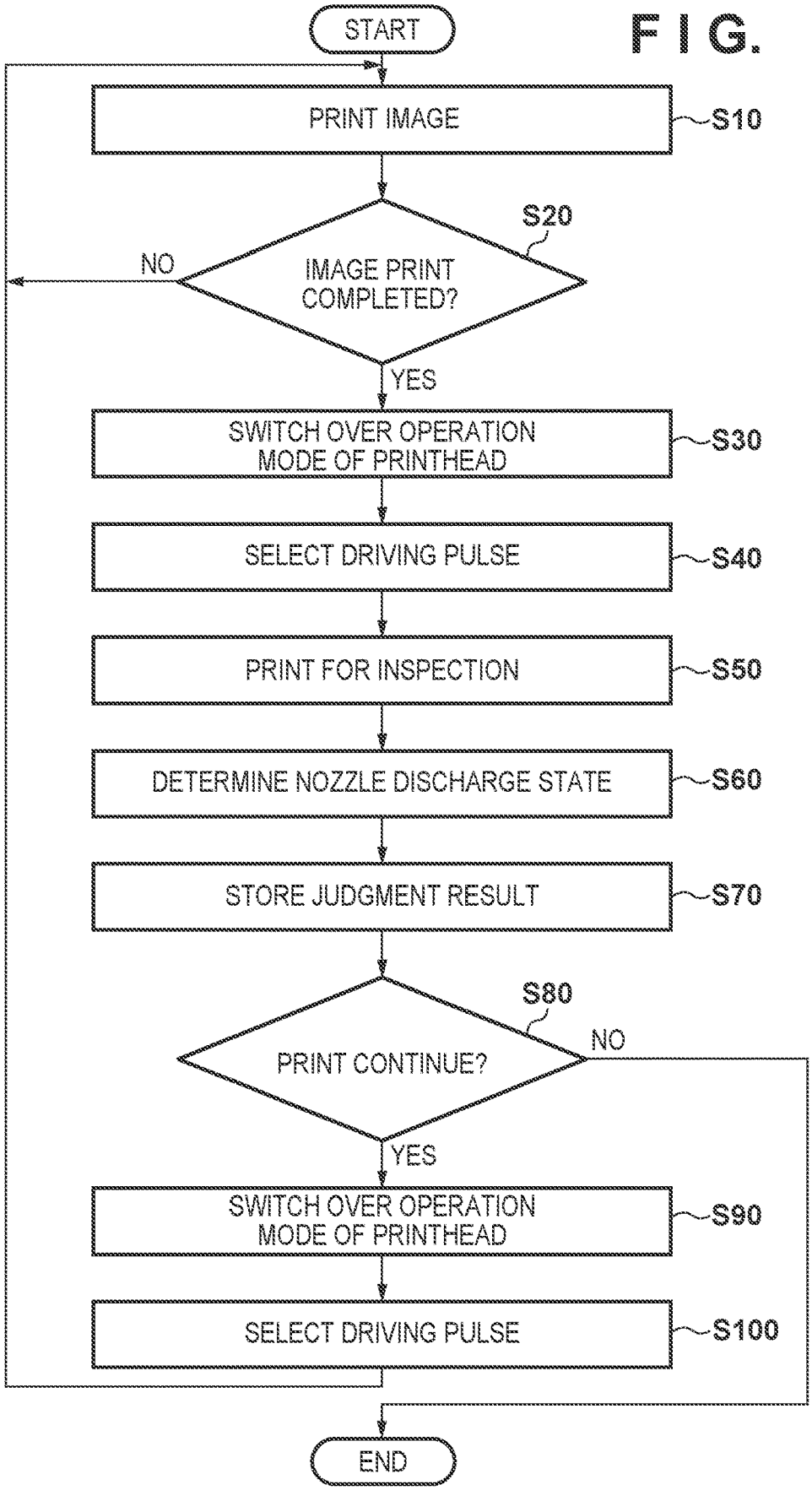
FIG. 18 is a flowchart illustrating inspection processing.

FIG. 18 is a flowchart illustrating processing of inspecting the nozzle discharge state.

This inspection processing is executed during execution of a series of processes of forming an image on the surface of the transfer member 2 by discharging ink from the printhead 30 while continuously rotating the transfer member 2 and transferring the formed image to the fed print medium P.

In step S10, image printing is executed by discharging ink from the printhead 30 to the actual image area of the transfer member 2. At this time, the printing control unit 15A counts, from the leading end of the transfer member 2 (print medium P), the number of lines having undergone printing with respect to the rotation direction of the transfer member (the conveyance direction of the print medium). In step S20, it is checked whether the counted number has reached the number of lines corresponding to the actual image area L1. If the counted number is smaller than the number of lines corresponding to the actual image area L1, the process returns to step S10 to continue image printing. On the other hand, if it is judged that the counted number has reached the number of lines corresponding to the actual image area L1, the process advances to step S30.

In step S30, in consideration of the fact that the nozzle arrays of the head substrate intersect the conveyance direction of the print medium and discharge timings of the respective nozzles are different with respect to the conveyance direction, the process waits until the discharge operations of all the nozzles end, and the operation mode of the printhead is switched over. That is, the operation mode of the printhead 30 is switched over from the printing mode to the inspection mode. Furthermore, in step S40, the drive pulse used in the inspection mode is selected. This selects, as a drive pulse, the drive pulse PLS1 or PLS2 shown in FIG. 11.

In step S50, the printhead 30 is driven using the selected drive pulse to print the inspection pattern by selectively, time-divisionally driving the nozzles (heaters) based on the inspection data, as described with reference to FIG. 14. Then, in step S60, a change in temperature of each nozzle (heater) is monitored, and the discharge state of each nozzle is judged based on a change in temperature. Note that the method of judging the discharge state is known, and a description thereof will be omitted. Furthermore, in step S70, the judgement result is stored in the storage unit 132.

In step S80, it is judged whether to continue printing. If it is judged to end printing, the process ends. However, if it is judged to continue printing, the process advances to step S90. In step S90, the operation mode of the printhead 30 is switched over again from the inspection mode to the printing mode. Furthermore, in step S100, a drive pulse to be used in the printing mode is selected. This selects, as the drive pulse, the drive pulse PLS0 shown in FIG. 11. After that, the process returns to step S10 to continue image printing.

Note that if, as a result of the above-described inspection processing, the inspected nozzle is judged as a failure nozzle, when a normal nozzle exists near the failure nozzle, complementary printing is desirably performed by discharging ink from the nearby nozzle. However, if the number of nozzles that are judged as failure nozzles is very large and it is difficult to continue high-quality printing, the operation of the printing apparatus is stopped to display a message for prompting the user to replace or maintain the printhead.

Therefore, according to the above-described embodiment, it is possible to inspect the nozzle discharge state of the printhead while continuing image printing. Specifically, in inspection, drive conditions such as the drive pulse dedicated for inspection are used, thereby enabling accurate inspection.

Other Embodiment

In the above embodiment, the print unit 3 includes the plurality of printheads 30. However, a print unit 3 may include one printhead 30. The printhead 30 may not be a full-line head but may be of a serial type that forms an ink image while scanning the printhead 30 in a Y direction.

A conveyance mechanism of the print medium P may adopt another method such as a method of clipping and conveying the print medium P by the pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and running it cyclically may be used.

Furthermore, the printing system according to the above embodiment adopts the method of forming an image on the transfer member and transferring the image to the print medium. The present invention, however, is not limited to this. For example, the present invention is also applicable to a printing apparatus that adopts a method of forming an image by discharging ink from the printhead to the print medium directly. In this case, the printhead used may be a full-line head or a serial type printhead that reciprocally moves.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-148715, filed Aug. 7, 2018, and No. 2019-036837, filed Feb. 28, 2019, which are hereby incorporated by reference herein in their entirety.

What is claimed is:

1. A printing apparatus comprising:

a printhead including:

a plurality of nozzles, each configured to discharge ink, and a plurality of sensors, corresponding to the plurality of nozzles, each configured to detect a discharge state of ink from the plurality of nozzles;

a print control unit configured to:

cause the printhead to print, based on print data, an image by driving the printhead under a first drive condition to discharge ink from the printhead, and cause the printhead to discharge ink by driving the printhead, based on inspection data, under a second drive condition different from the first drive condition; and a judgement unit configured to judge a discharge state of each of the plurality of nozzles, based on an output from each of the plurality of sensors at a timing of driving the printhead by the print control unit under the second drive condition.

2. The apparatus according to claim 1, wherein the printhead includes a plurality of heaters, corresponding to the plurality of nozzles, each configured to apply heat energy to ink to be discharged from each of the plurality of nozzles, each of the plurality of sensors serves as a temperature sensor configured to detect a temperature of the corresponding heater, each of the heaters and the corresponding temperature sensor are integrated in a multilayer element substrate, and each of the temperature sensors is provided immediately below the corresponding heater in a layer different from a layer in which the corresponding heater is provided.

3. The apparatus according to claim 2, wherein the judgement unit judges a discharge state of each of the plurality of nozzles based on a change in temperature detected by the corresponding temperature sensor.

4. The apparatus according to claim 3, wherein if a nozzle judged, by the judgement unit, to be satisfactory exists near a nozzle judged as a failure, the print control unit causes the printhead to perform complementary printing by the nozzle judged to be satisfactory.

5. The apparatus according to claim 1, wherein each of the first drive condition and the second drive condition includes a drive pulse to drive the printhead, and the drive pulse in the first drive condition is different from the drive pulse in the second drive condition.

6. The apparatus according to claim 5, wherein the second drive condition is a drive condition that makes a discharge speed lower than a discharge speed under the first drive condition.

7. The apparatus according to claim 1, wherein the printhead is a full-line printhead having a print width corresponding to a width of a print medium.

8. The apparatus according to claim 1, wherein a nozzle array formed from the plurality of nozzles is provided with a given angle with respect to a direction intersecting a conveyance direction of a print medium, and inspection is performed from the nozzle located on a downstream side in the conveyance direction of the print medium.

9. The apparatus according to claim 8, further comprising a storage unit configured to store a table indicating a drive pulse corresponding to the second drive condition and a drive pulse used to perform preliminary discharge from the plurality of nozzles before judgement of a discharge state by the judgement unit, wherein the print control unit selects, based on the table, a drive pulse when judging a discharge state of each of the plurality of nozzles.

10. The apparatus according to claim 9, wherein in the table, a predetermined number of nozzles corresponds to a drive pulse corresponding to the second drive condition, a number of nozzles greater than the predetermined number corresponds to one of a plurality of types of drive pulses for the preliminary discharge, the print control unit selects a drive pulse using the table in accordance with a number of nozzles used, and the print control unit uses the predetermined number of nozzles to judge the discharge state by the judgement unit.

11. The apparatus according to claim 8, wherein the print control unit:

causes the printhead to print, based on the print data, the image by driving the printhead under the first drive condition to discharge ink from the printhead to a first area, and causes the printhead to discharge ink to a second area different from the first area by driving the printhead, based on the inspection data, under the second drive condition.

12. The apparatus according to claim 11, wherein the printhead forms an image by discharging the ink to a conveyed print medium, and the first area and the second area are areas of the print medium.

13. The apparatus according to claim 12, wherein the second area is situated on one of an upstream side and a downstream side of the first area with respect to a conveyance direction of the print medium.

14. The apparatus according to claim 12, wherein a direction of a nozzle array formed by the plurality of nozzles is a direction intersecting a conveyance direction of the print medium.

15. The apparatus according to claim 14, wherein if printing in the first area and printing in the second area are switched over in accordance with one of rotation of the transfer member and conveyance of the print medium, a buffer area is provided between the first area and the second area based on a distance, generated by the intersection of the nozzle array, between nozzles at two ends of the nozzle array with respect to the conveyance direction of the print medium.

16. The apparatus according to claim 15, wherein the print control unit causes the printhead to perform, in the buffer area, preliminary discharge for a nozzle to be inspected.

17. The apparatus according to claim 8, wherein the printhead is driven to judge the discharge state after preliminary discharge.

18. The apparatus according to claim 8, wherein preliminary discharge, driving the printhead to judge the discharge state of a first nozzle, preliminary discharge, and driving the printhead to judge the discharge state of a second nozzle are performed sequentially in this order.

19. The apparatus according to claim 18, wherein the first nozzle and the second nozzle are not adjacent.

20. The apparatus according to claim 8, wherein
a width of a drive pulse of the second drive condition is longer than a width of a drive pulse of the first drive condition.

21. The apparatus according to claim 8, wherein
a total width of a drive pulse of the second drive condition is a longer than a total width of a drive pulse of the first drive condition.

22. The apparatus according to claim 8, wherein
the printhead is of a serial type that forms an image while scanning the printhead in a direction intersecting the conveyance direction of the print medium.

23. The apparatus according to claim 8, wherein
a drive pulse for a preliminary discharge is the same as that for printing the image.

24. The apparatus according to claim 8, wherein
a drive pulse for a preliminary discharge is different from that for printing the image.

25. The apparatus according to claim 8, wherein
in a case of printing the image based on the print data, when letting a width of a drive pulse for driving a first number of nozzles be a first width, and letting a width of a drive pulse for driving a second number of nozzles be a second width, the second number being greater than the first number, the second width is longer than the first width.

26. The apparatus according to claim 8, further comprising a recovery unit having a mechanism for recovering discharge performance of the printhead, wherein
a region for printing the image, a region for preliminary discharge, and a region for the recovering by the recovery unit are arranged in a direction intersecting a conveyance direction of a print medium.

27. The apparatus according to claim 8, further comprising a circulation unit configured to circulate ink through the printhead.

28. The apparatus according to claim 8, further comprising a circulation unit configured to circulate ink through a liquid passageway which is provided between a reservoir storing ink and the printhead.

29. The apparatus according to claim 8, wherein
a height of a reservoir storing ink and the printhead are designed such that the liquid surface of ink in the reservoir is positioned lower than an ink discharge surface of the printhead.

30. A method of judging a nozzle discharge state of a printing apparatus having a printhead including a plurality of nozzles, each configured to discharge ink, and a plurality of sensors, corresponding to the plurality of nozzles, each configured to detect a discharge state of ink from the plurality of nozzles, the method comprising:
printing, based on print data, an image by driving the printhead under a first drive condition to discharge the ink from the printhead;
discharging ink by driving the printhead, based on inspection data, under a second drive condition different from the first drive condition; and
judging a discharge state of each of the plurality of nozzles based on an output from each of the plurality of sensors at a timing of driving the printhead under the second drive condition.

31. The method according to claim 30, wherein
in the printing, the image is printed, based on the print data, by driving the printhead under the first drive condition to discharge ink from the printhead to a first area, and
in the discharging, ink is discharged to a second area different from the first area by driving the printhead, based on the inspection data, under the second drive condition.

32. The method according to claim 31, wherein
the printhead forms an image by discharging the ink to a conveyed print medium, and
the first area and the second area are areas of the print medium.

33. The method according to claim 30, wherein
the printhead is driven to judge the discharge state after preliminary discharge.

34. The method according to claim 30, wherein
a width of a drive pulse of the second drive condition is a longer than a width of a drive pulse of the first drive condition.

35. The method according to claim 30, wherein
a total width of a drive pulse of the second drive condition is a longer than a total width of a drive pulse of the first drive condition.

* * * * *